US011262674B2

(12) United States Patent
Ichiki et al.

(10) Patent No.: US 11,262,674 B2
(45) Date of Patent: Mar. 1, 2022

(54) IMAGE FORMING APPARATUS

(71) Applicant: FUJIFILM BUSINESS INNOVATION CORP., Tokyo (JP)

(72) Inventors: Yukihiro Ichiki, Kanagawa (JP); Akira Shimodaira, Kanagawa (JP); Keita Hashimoto, Kanagawa (JP); Toshihiro Goda, Kanagawa (JP); Masaki Suto, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/143,222

(22) Filed: Jan. 7, 2021

(65) Prior Publication Data

US 2021/0124290 A1 Apr. 29, 2021

Related U.S. Application Data

(62) Division of application No. 16/529,091, filed on Aug. 1, 2019, now Pat. No. 10,915,043.

(30) Foreign Application Priority Data

Sep. 4, 2018 (JP) ..... JP2018-165403
Sep. 19, 2018 (JP) ..... JP2018-175249

(51) Int. Cl.
*G03G 15/16* (2006.01)

(52) U.S. Cl.
CPC ..... *G03G 15/1615* (2013.01); *G03G 15/1665* (2013.01)

(58) Field of Classification Search
CPC ..... G03G 15/1615; G03G 15/1665; G03G 15/0189; G03G 21/1604; G03G 15/1605; G03G 15/6529
See application file for complete search history.

(56) References Cited

U.S. PATENT DOCUMENTS 5,821,968 A 10/1998 Ohyama et al.
6,097,924 A 8/2000 Okuyama
(Continued)

FOREIGN PATENT DOCUMENTS

JP 2007-304192 A 11/2007
JP 2007-310226 A 11/2007
(Continued)

*Primary Examiner* — David J Bolduc
(74) *Attorney, Agent, or Firm* — Oliff PLC

(57) ABSTRACT

An image forming apparatus includes a transport belt, a first intermediate transfer belt, and a second intermediate transfer belt. The transport belt is disposed along a transport path extending in a vertical direction. The transport belt is configured to transport a recording medium while coming into contact with one surface of the recording medium. The first intermediate transfer belt is configured to sandwich the recording medium together with the transport belt. An image is transferred from the first intermediate transfer belt to the recording medium. The second intermediate transfer belt is disposed above the first intermediate transfer belt. The second intermediate transfer belt is configured to sandwich, together with the transport belt, the recording medium which is in a state where the recording medium is sandwiched between the first intermediate transfer belt and the transport belt. An image being transferred from the second intermediate transfer belt to the recording medium.

7 Claims, 10 Drawing Sheets

(56) References Cited

U.S. PATENT DOCUMENTS 6,819,902 B2 11/2004 Toyohara et al.
6,947,682 B2 9/2005 Kosugi et al.
6,999,196 B2 2/2006 Ishida
7,046,947 B1 5/2006 Castelli et al.
7,558,510 B2 7/2009 Iwasaki
7,702,259 B2 4/2010 Eun et al.
7,957,660 B2 6/2011 Kaneko et al.
8,249,468 B2 * 8/2012 Kuma ..... G03G 15/167 399/21
8,358,944 B2 1/2013 Yamade
8,446,597 B2 5/2013 Enami et al.
8,682,233 B2 3/2014 deJong et al.
8,712,299 B2 4/2014 Sugita et al.
8,995,857 B2 * 3/2015 Iguchi ..... B41J 3/546 399/63
2001/0046389 A1 11/2001 Kuribayashi et al.
2002/0122679 A1 9/2002 Omata et al.
2005/0190250 A1 9/2005 Howarth et al.
2006/0033968 A1 2/2006 Maki
2006/0045565 A1 3/2006 Ueno et al.
2006/0072929 A1 4/2006 Takahashi
2006/0120742 A1 6/2006 Kodama et al.
2006/0188299 A1 8/2006 Matsumoto
2007/0014596 A1 1/2007 Sohmiya et al.
2007/0098472 A1 5/2007 Saeki et al.
2007/0253754 A1 11/2007 Kobayashi et al.
2007/0264032 A1 11/2007 Harumoto
2007/0268321 A1 11/2007 Kawamata
2008/0124123 A1 5/2008 Masuda
2008/0304879 A1 12/2008 Tamura
2009/0279906 A1 11/2009 Kuma et al.
2009/0290892 A1 11/2009 Torimaru
2009/0317104 A1 12/2009 Katoh et al.
2010/0021219 A1 1/2010 Hori
2010/0040393 A1 2/2010 Kawahara et al.
2010/0061752 A1 3/2010 Sudo et al.
2010/0196063 A1 8/2010 Iguchi et al.
2010/0272449 A1 10/2010 Yoshida et al.
2010/0303487 A1 12/2010 Miyakawa et al.
2010/0303514 A1 12/2010 Ishii et al.
2011/0013950 A1 1/2011 Furuya et al.
2011/0085828 A1 4/2011 Kosako et al.
2011/0204557 A1 8/2011 Ishikawa et al.
2012/0148301 A1 6/2012 Nakaegawa
2012/0207518 A1 8/2012 Krucinski et al.
2012/0251199 A1 10/2012 Miyazaki
2014/0028750 A1 1/2014 Fletcher et al.
2014/0079452 A1 3/2014 Arikawa et al.
2014/0300933 A1 * 10/2014 Yoshida ..... H04N 1/2323 358/2.1
2016/0209785 A1 7/2016 Michishita et al.
2016/0209787 A1 7/2016 Michishita et al.

FOREIGN PATENT DOCUMENTS

JP 2009-086517 A 4/2009
JP 2014-059391 A 4/2014

* cited by examiner

IMAGE FORMING APPARATUS

CROSS-REFERENCE TO RELATED APPLICATIONS

This application is a divisional application of U.S. patent application Ser. No. 16/529,091, filed Aug. 1, 2019, which is based on and claims priority under 35 U.S.C. § 119 from Japanese Patent Application No. 2018-175249 filed Sep. 19, 2018 and Japanese Patent Application No. 2018-165403 filed Sep. 4, 2018, each of which is hereby incorporated by reference.

BACKGROUND

(i) Technical Field

The present disclosure relates to an image forming apparatus.

(ii) Related Art

JP-A-2009-86517 discloses an image forming apparatus including a transport belt which transports a sheet in the vertical direction and an attraction roller which attracts the sheet to the transport belt.

SUMMARY

Aspects of non-limiting embodiments of the present disclosure relate to provide an image forming apparatus capable of forming a multicolor image using plural intermediate transfer belts.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an image forming apparatus including: a transport belt disposed along a transport path extending in a vertical direction, the transport belt being configured to transport a recording medium while coming into contact with one surface of the recording medium; a first intermediate transfer belt configured to sandwich the recording medium together with the transport belt, an image being transferred from the first intermediate transfer belt to the recording medium; and a second intermediate transfer belt disposed above the first intermediate transfer belt, the second intermediate transfer belt being configured to sandwich, together with the transport belt, the recording medium which is in a state where the recording medium is sandwiched between the first intermediate transfer belt and the transport belt, an image being transferred from the second intermediate transfer belt to the recording medium.

BRIEF DESCRIPTION OF THE DRAWINGS

Exemplary embodiments of the present disclosure will be described in detail based on the following figures, wherein.

DETAILED DESCRIPTION

Figure 1:
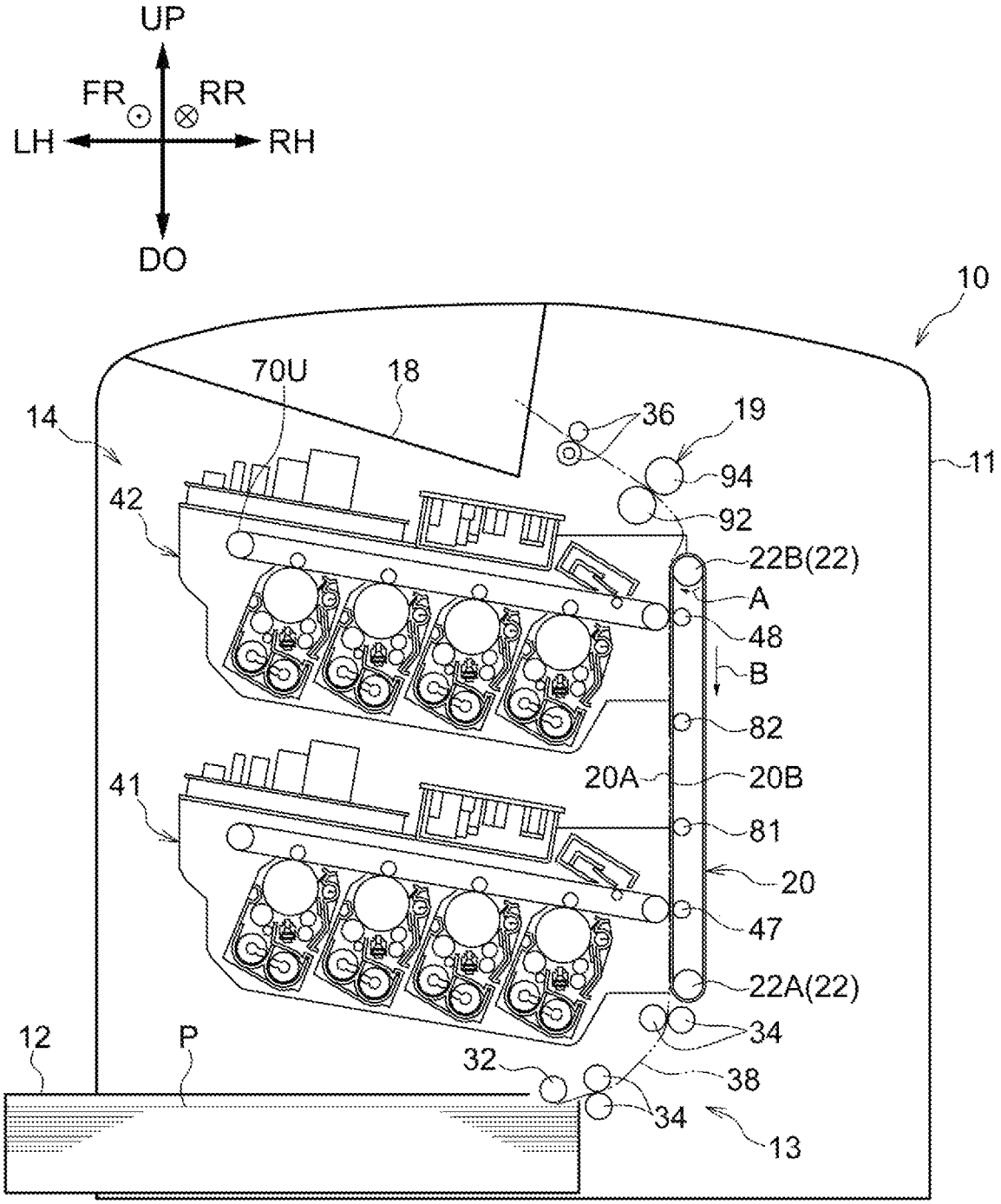
FIG. 1 is a schematic view illustrating a configuration of an image forming apparatus according to a first exemplary embodiment.

Hereinafter, exemplary embodiments according to the present disclosure will be described based on the drawings.

In addition, the arrow UP illustrated in the drawings indicates the upper side (vertical upper side) of the apparatus, and the arrow DO indicates the lower side (vertical lower side) of the apparatus. Further, the arrow LH illustrated in the drawings indicates the left side of the apparatus, and the arrow RH indicates the right side of the apparatus. Further, the arrow FR illustrated in the drawings indicates the front side of the apparatus, and the arrow RR indicates the rear side of the apparatus. Since these directions are directions defined for the convenience of description, the apparatus configuration is not limited to these directions.

Further, the direction along the upper side and the lower side of the apparatus may be referred to as the vertical direction of the apparatus. The vertical direction of the apparatus is also the gravitational direction. Further, the direction along the left side and the right side of the apparatus may be referred to as the left-and-right direction of the apparatus. The left-and-right direction of the apparatus is also the width direction (horizontal direction) of the apparatus. Further, the direction along the front side and the rear side of the apparatus may be referred to as the front-and-rear direction of the apparatus. The front-and-rear direction of the apparatus is also the depth direction (horizontal direction) of the apparatus. In addition, in each direction of the apparatus, the word "apparatus" may be omitted. That is, for example, "the upper side of the apparatus" may be simply referred to as "the upper side".

Further, the symbol in which "x" is described in "o" in the drawings means the arrow going from the front to the back of paper. Further, the symbol in which "." is described in "o" in the drawings means the arrow going from the back to the front of paper.

<Image Forming Apparatus 10>

A configuration of an image forming apparatus 10 according to a first exemplary embodiment will be described. FIG. 1 is a schematic view illustrating a configuration of an image forming apparatus 10 according to a first exemplary embodiment.

The image forming apparatus 10 illustrated in FIG. 1 is an example of an image forming apparatus that forms an image on a recording medium. Specifically, the image forming apparatus 10 is an electrophotographic image forming apparatus that forms a toner image (an example of an image) on a recording medium P. More specifically, as illustrated in FIG. 1, the image forming apparatus 10 includes an apparatus body 11, an accommodating unit 12, a discharge unit 18, a transport unit 13, an image forming device 14, a fixing device 19, and charge applying rollers 81 and 82. Hereinafter, each unit of the image forming apparatus 10 (the apparatus body 11, the accommodating unit 12, the discharge unit 18, the transport unit 13, the image forming device 14, the fixing device 19, and the charge applying rollers 81 and 82) will be described.

(Apparatus Body 11, Accommodating Unit 12, and Discharge Unit 18)

The apparatus body 11 illustrated in FIG. 1 has a function of accommodating each component therein. The apparatus body 11 is configured with, for example, a box-shaped housing.

The accommodating unit 12 has a function of accommodating the recording medium P such as a sheet. The accommodating unit 12 is provided in a lower portion inside the apparatus body 11 as illustrated in FIG. 1. In the first exemplary embodiment, the recording medium P is accommodated in the accommodating unit 12 by being stacked in the accommodating unit 12.

The discharge unit 18 has a function of discharging the recording medium P on which a toner image has been formed. The discharge unit 18 is provided in an upper region of the apparatus body 11 as illustrated in FIG. 1. In the first exemplary embodiment, the recording medium P discharged toward the discharge unit 18 is stacked on the discharge unit 18.

(Transport Unit 13)

The transport unit 13 illustrated in FIG. 1 has a function of transporting the recording medium P. Specifically, the transport unit 13 has a function of transporting the recording medium P along a transport path 38 extending along the vertical direction. More specifically, the transport unit 13 has a function of transporting the recording medium P upward from the accommodating unit 12 to the discharge unit 18 in the transport path 38.

To describe further, as illustrated in FIG. 1, the transport unit 13 includes a delivery roller 32, plural transport rollers 34, a transport belt 20, and a discharge roller 36. The delivery roller 32 is a roller that delivers the recording medium P accommodated in the accommodating unit 12. The plural transport rollers 34 are rollers that transport the recording medium P delivered by the delivery roller 32 toward the transport belt 20.

The transport belt 20 is disposed along the transport path 38 extending along the vertical direction. The transport belt 20 has a function of transporting the recording medium P by coming into contact with one surface of the recording medium P.

Specifically, the transport belt 20 takes the shape of a band having a width in the front-and-rear direction, and is formed in an annular shape. More specifically, the transport belt 20 is formed, for example, in an endless shape having no end.

To describe further, the transport belt 20 is wound around a pair of rollers 22. Specifically, the transport belt 20 is wound in a state where tension is applied to the pair of rollers 22 spaced apart from each other by a distance in the up-and-down direction (vertical direction). More specifically, the transport belt 20 is wound in a state where tension is applied to a driven roller 22A disposed at the lower portion inside the apparatus body 11 and a driving roller 22B disposed above the driven roller 22A as the pair of rollers 22. In the first exemplary embodiment, when the driving roller 22B is rotated in one direction (the direction of the arrow A) by, for example, a motor 68 of a second image forming unit 42 to be described later, the transport belt 20 circulates in one direction (the direction of the arrow B).

To describe further, the transport belt 20 has a function of transporting the recording medium P by coming into contact at the outer peripheral surface thereof with a non-image surface of the recording medium P. Specifically, the transport belt 20 comes into contact with the non-image surface of the recording medium P at a contact surface 20A facing the left side (the side of a first intermediate transfer belt 71 and a second intermediate transfer belt 72 to be described later) of the outer peripheral surface to transport the recording medium P. In addition, specifically, the contact surface 20A is a surface extending linearly along the vertical direction. Further, the non-image surface of the recording medium P is the surface opposite to an image surface on which a toner image is formed. As described above, in the first exemplary embodiment, the transport belt 20 is configured to transport the recording medium P from the lower side to the upper side in the gravitational direction.

The discharge roller 36 is a roller that discharges the recording medium P which has passed through the fixing device 19 after transported by the transport belt 20 to the discharge unit 18.

As described above, the transport unit 13 transports the recording medium P upward. Thus, in the transport unit 13, the upward direction is taken as a transport direction. Further, in the transport unit 13, the lower side is the upstream side in the transport direction, and the upper side is the downstream side in the transport direction.

(Image Forming Device 14)

The image forming device 14 illustrated in FIG. 1 has a function of forming a toner image (an example of an image) on the recording medium P. Specifically, as illustrated in FIG. 1, the image forming device 14 includes a first image forming unit 41, a second image forming unit 42, and two secondary transfer rollers 47 and 48. The first image forming unit 41 is an example of a first image forming unit. The second image forming unit 42 is an example of a second image forming unit.

Hereinafter, a configuration of the first image forming unit 41, the second image forming unit 42, and the two secondary transfer rollers 47 and 48 will be described. Furthermore, an arrangement of constituent units (components) constituting the image forming device 14 will be described.

[First Image Forming Unit 41]

Figure 2:
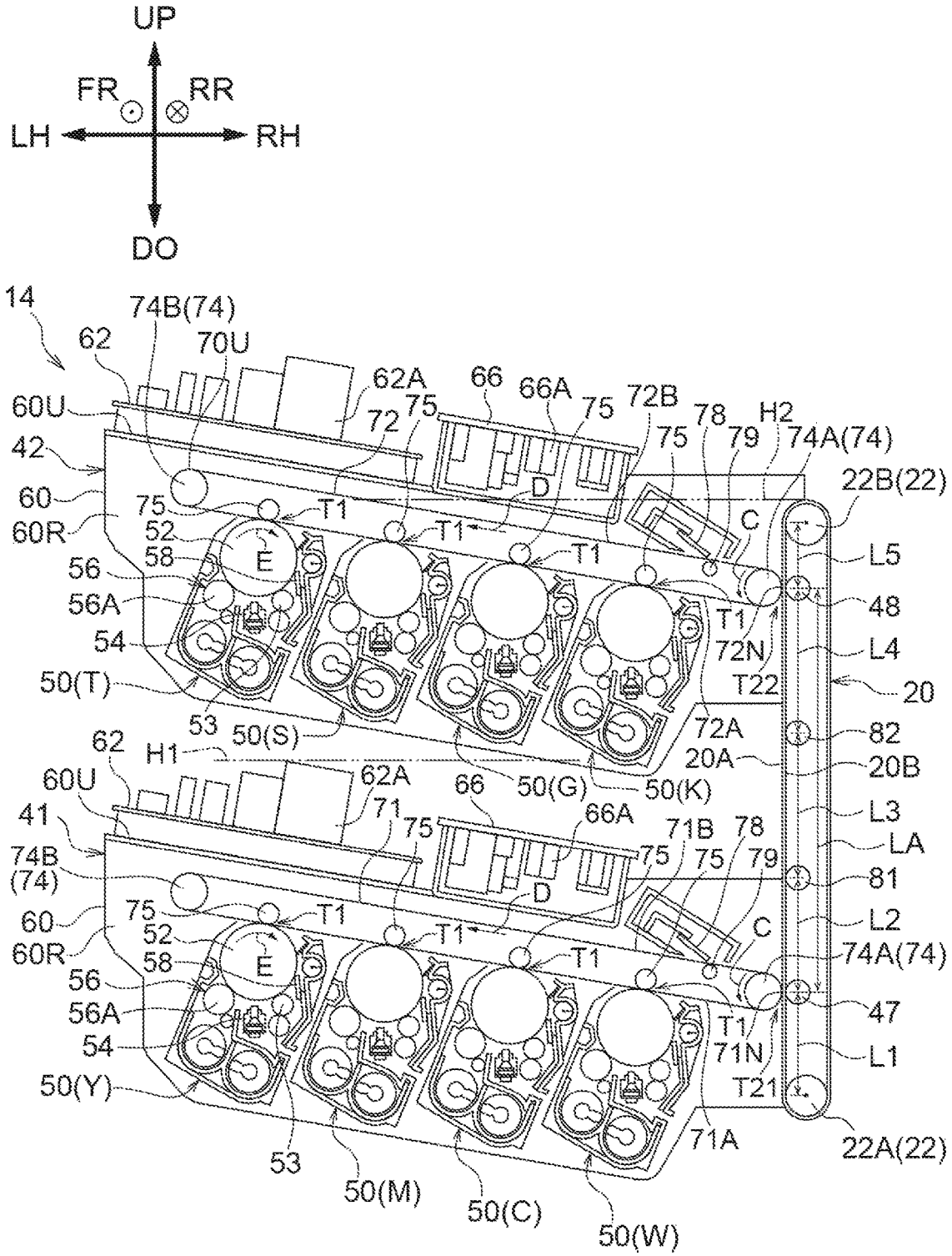
FIG. 2 is a schematic view illustrating a configuration of a transport belt, a first image forming unit, and a second image forming unit according to the first exemplary embodiment.

As illustrated in FIG. 1, the first image forming unit 41 is provided in a lower portion inside the apparatus body 11. The first image forming unit 41, as illustrated in FIGS. 2 and 3, includes a unit body 60, four toner image forming sections 50, four primary transfer rollers 75, the first intermediate transfer belt 71, the motor 68, a power supply board 62, a control board 64, and a high voltage power supply board 66.

Specifically, the first image forming unit 41 includes, as the four toner image forming sections 50, toner image forming sections 50 for total four colors of yellow (Y), magenta (M), cyan (C), and white (W). The reference characters "Y", "M", "C", and "W" illustrated in FIG. 2 indicate components corresponding to the respective colors. Further, since the toner image forming sections 50 of the respective colors are configured in the same manner except for a toner, on behalf of the toner image forming section 50 of each color, the reference numeral is given to each component of the toner image forming section 50(Y) in FIG. 2. Hereinafter, each component of the first image forming unit 41 (the unit body 60, the four toner image forming sections 50, the four primary transfer rollers 75, the first intermediate transfer belt 71, the motor 68, the power supply board 62, the control board 64, and the high voltage power supply board 66) will be described.

[Unit Body 60]

Figure 3:
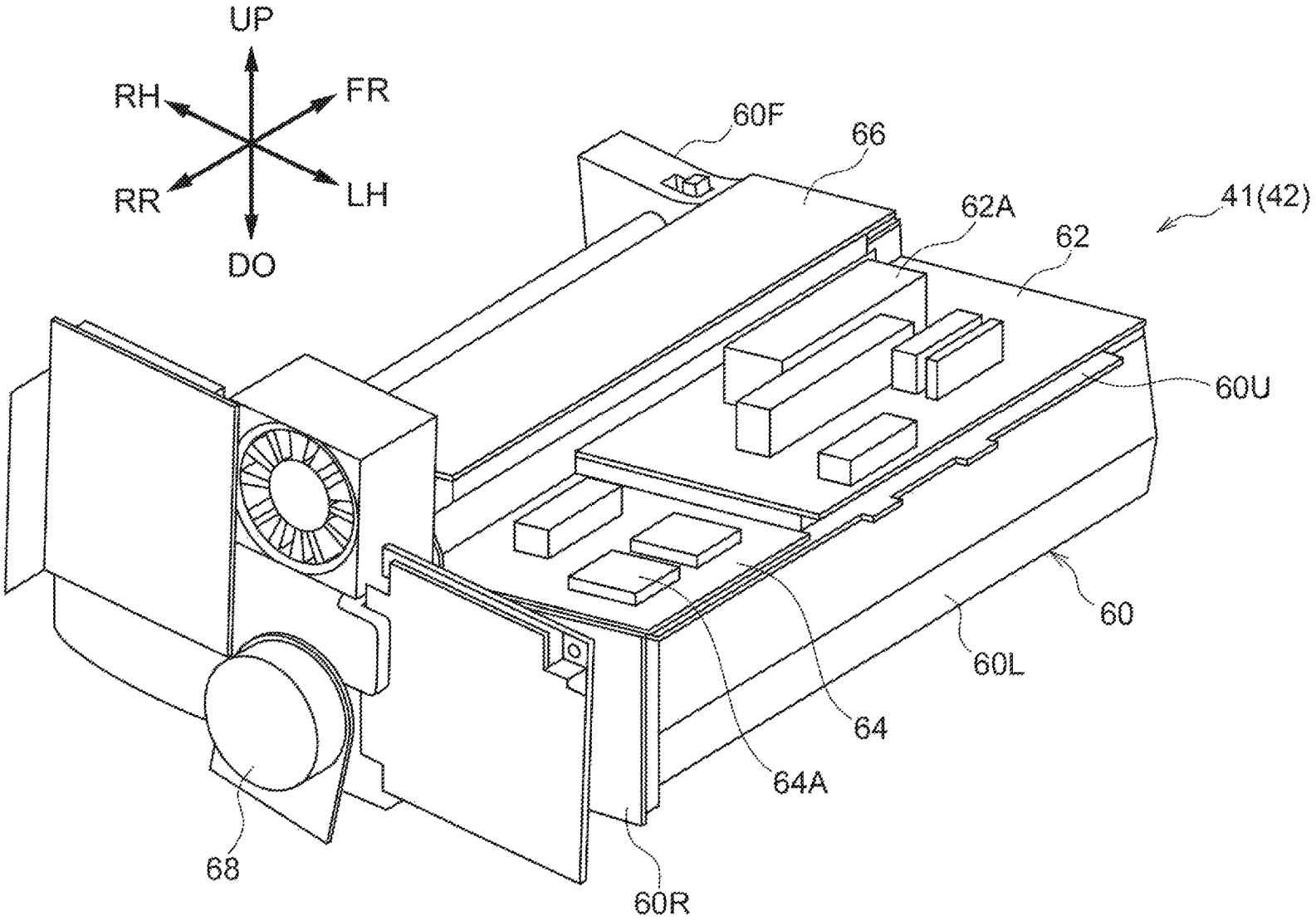
FIG. 3 is a perspective view illustrating a configuration of the first image forming unit (second image forming unit) according to the first exemplary embodiment.

The unit body 60 illustrated in FIG. 3 functions as a support body that supports each component of the first image forming unit 41. The unit body 60 is configured with, for example, a frame formed of a sheet metal. The unit body 60 includes, for example, an upper wall 60U, a front wall 60F, a rear wall 60R, and a left wall 60L (side wall), as illustrated in FIG. 3. In addition, in FIG. 2, the front wall 60F and the left wall 60L (side wall) are omitted.

[Toner Image Forming Section 50]

As illustrated in FIG. 2, the toner image forming section 50 of each color includes a photoconductor drum 52 (photoconductor) which rotates in one direction (the direction of the arrow E). Furthermore, the toner image forming section 50 of each color includes a charging device 53, an exposure device 54, a developing device 56, and a removing device 58.

In the toner image forming section 50 of each color, the charging device 53 charges the photoconductor drum 52. Furthermore, the exposure device 54 exposes the photoconductor drum 52 charged by the charging device 53 to form an electrostatic latent image on the photoconductor drum 52. Further, the developing device 56 develops the electrostatic latent image formed on the photoconductor drum 52 by the exposure device 54 to form a toner image. The removing device 58 is configured with a blade which removes the toner remaining on the photoconductor drum 52 after the toner image is transferred onto the first intermediate transfer belt 71 to be described later.

[Primary Transfer Roller 75]

The four primary transfer rollers 75 are disposed on the inner side (inner peripheral side) of the first intermediate transfer belt 71, as illustrated in FIG. 2. Specifically, each of the four primary transfer rollers 75 is disposed to face the photoconductor drum 52 of a corresponding color via the first intermediate transfer belt 71.

Each primary transfer roller 75 has a function of transferring the toner image on the photoconductor drum 52 of a corresponding color onto the first intermediate transfer belt 71 at a primary transfer position T1 between the photoconductor drum 52 and the primary transfer roller 75. In the first exemplary embodiment, by applying a primary transfer electric field between the primary transfer roller 75 and the photoconductor drum 52, the toner image formed on the photoconductor drum 52 is transferred onto the first intermediate transfer belt 71 at the primary transfer position T1. In this way, the toner images on the photoconductor drums 52 of the respective colors are primarily transferred onto the first intermediate transfer belt 71 in an overlapping manner.

[First Intermediate Transfer Belt 71]

The first intermediate transfer belt 71 has a function of holding the toner image transferred from the photoconductor drum 52 of each color of the first image forming unit 41. Furthermore, the first intermediate transfer belt 71 has a function of transporting the held toner image to a first secondary transfer position T21 to be described later. Specifically, the first intermediate transfer belt 71 is configured as follows.

The first intermediate transfer belt 71 takes the shape of a band having a width in the front-and-rear direction, and is formed in an annular shape. Specifically, the first intermediate transfer belt 71 is formed, for example, in an endless shape having no end.

To describe further, the first intermediate transfer belt 71 is wound around a pair of rollers 74. The pair of rollers 74 include a driving roller 74A (an example of a first roller) facing the transport belt 20 via the first intermediate transfer belt 71 and a driven roller 74B (an example of a second roller) disposed on the opposite side (left side) of the driving roller 74A to the transport belt 20. Then, the first intermediate transfer belt 71 is wound around only the driving roller 74A and the driven roller 74B in a tensioned state. In the first exemplary embodiment, when the driving roller 74A is rotated by the motor 68 in one direction (the direction of the arrow C), the first intermediate transfer belt 71 circulates in one direction (the direction of the arrow D). In addition, the driving roller 74A functions as an opposing roller (backup roller) of the secondary transfer roller 48.

The first intermediate transfer belt 71 has a contact area 71N (nip area) which is in contact with the transport belt 20 in a portion thereof wound around the driving roller 74A. The contact area 71N is the first secondary transfer position T21 at which the toner image on the first intermediate transfer belt 71 is transferred onto the recording medium P. Further, the first intermediate transfer belt 71 sandwiches and transports the recording medium P together with the transport belt 20 in the contact area 71N. The first secondary transfer position T21 is an example of a first transfer position.

The first image forming unit 41 includes a removing unit 78 which removes the toner remaining on the first intermediate transfer belt 71 after the toner image is transferred onto the recording medium P. The removing unit 78 is configured with a blade disposed between the high voltage power supply board 66 and the transport belt 20 at the upper side of the first intermediate transfer belt 71. An opposing roller 79 is provided below the removing unit 78 to face the removing unit 78 via the first intermediate transfer belt 71.

[Motor 68]

The motor 68 is provided on the rear wall 60R of the unit body 60 in the first image forming unit 41, as illustrated in FIG. 3. The motor 68 functions as a drive source which drives a driving component of the first image forming unit 41. Specifically, the motor 68 drives, for example, the photoconductor drum 52, a developing roller 56A of the developing device 56, and the driving roller 74A around which the first intermediate transfer belt 71 is wound via a gear train (not illustrated). Furthermore, the drive force of the motor 68 is transmitted to, for example, the delivery roller 32 and the plural transport rollers 34 of the transport unit 13 so that the delivery roller 32 and the plural transport rollers 34 are driven to rotate.

[Power Supply Board 62, Control Board 64, and High Voltage Power Supply Board 66]

The power supply board 62, the control board 64, and the high voltage power supply board 66 are provided on the top of the unit body 60, as illustrated in FIGS. 2 and 3. The power supply board 62 is an example of a circuit board.

The power supply board 62 has a function of receiving power supplied from an external power supply (not illustrated) of the image forming apparatus 10 via an electric wire (not illustrated) and supplying power of a predetermined voltage to the motor 68 or the like. The power supply board 62 includes an electronic component 62A on the upper surface thereof.

The control board 64 has a function of controlling the driving of each component of the first image forming unit 41. The control board 64 includes a recording unit which is configured with, for example, a ROM or a storage in which a program is recorded and a processor which operates according to a program. The control board 64 includes an electronic component 64A on the upper surface thereof.

Figure 4:
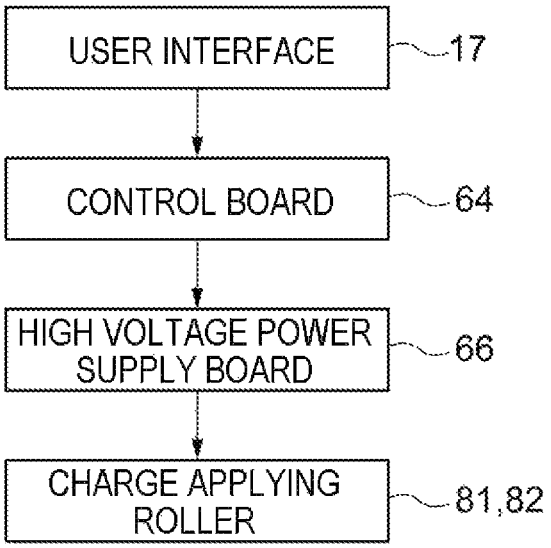
FIG. 4 is a schematic view illustrating a control system which controls an operation of a charge applying roller according to the first exemplary embodiment.

As illustrated in FIG. 4, a user interface 17 (hereinafter referred to as UI 17) as an operation unit is connected to the control board 64. The UI 17 is configured with, for example, a liquid crystal display with a touch panel. An operation button (virtual button) and information to be notified to an operator (user) are displayed on the screen of the UI.

The operator operates the operation button via the UI 17 to specify an image forming condition including selection of the type of the recording medium P. In addition, the operation unit may be, for example, a personal computer (PC) connected to the image forming apparatus 10 via a network as long as the operation unit is capable of specifying the image forming condition.

The high voltage power supply board 66 has a function of receiving power supplied from an external power supply (not illustrated) of the image forming apparatus 10 via an electric wire (not illustrated) and supplying power of a voltage higher than the voltage of the power supply board 62 to the charging device 53, the developing device 56, the four primary transfer rollers 75, the secondary transfer rollers 47 and 48, the charge applying rollers 81 and 82, and the like. The high voltage power supply board 66 includes an electronic component 66A on the lower surface thereof. In addition, the high voltage power supply board 66 may be configured to receive power supplied from the power supply board 62.

[Second Image Forming Unit 42]

The second image forming unit 42 is provided in an upper region inside the apparatus body 11. In the first exemplary embodiment, the second image forming unit 42 is configured in the same manner as the first image forming unit 41.

Specifically, the second image forming unit 42 includes the unit body 60, the four toner image forming sections 50, the four primary transfer rollers 75, the second intermediate transfer belt 72, the motor 68, the power supply board 62, the control board 64, and the high voltage power supply board 66.

The second image forming unit 42 includes, as the four toner image forming sections 50, toner image forming sections 50 for total four colors of transparent (T), silver (S), gold (G), and black (K). The reference characters "T", "5", "G", and "K" illustrated in FIG. 2 indicate components corresponding to the respective colors. Further, since the toner image forming sections 50 of the respective colors are configured in the same manner except for the toner to be used, on behalf of the toner image forming section 50 of each color, the reference numeral is given to each component of the toner image forming section 50(T) in FIG. 2. Further, since the toner image forming section 50 of the second image forming unit 42 is configured in the same manner as the toner image forming section 50 of the first image forming unit 41, a description thereof will be omitted.

Further, since each of the unit body 60, the four primary transfer rollers 75, the power supply board 62, the control board 64, and the high voltage power supply board 66 in the second image forming unit 42 is configured in the same manner as each of the unit body 60, the four primary transfer rollers 75, the power supply board 62, the control board 64, and the high voltage power supply board 66 in the first image forming unit 41, a description thereof will be omitted.

The motor 68 in the second image forming unit 42 drives, for example, the photoconductor drum 52, the developing roller 56A of the developing device 56, and the driving roller 74A around which the second intermediate transfer belt 72 is wound, for example, via a gear train (not illustrated). Furthermore, the drive force of the motor 68 is transmitted to, for example, the driving roller 22B of the transport belt 20 and a heating roller 92 of the fixing device 19 to be described later so that the driving roller 22B and the heating roller 92 are driven to rotate. In addition, the same reference numeral is appropriately given to each component of the second image forming unit 42 having the same function as each component of the first image forming unit 41.

[Second Intermediate Transfer Belt 72]

The second intermediate transfer belt 72 is configured in the same manner as the first intermediate transfer belt 71 of the first image forming unit 41, and is wound around only the pair of rollers 74 including the driving roller 74A (an example of the first roller) and the driven roller 74B (an example of the second roller). The second intermediate transfer belt 72 has a function of holding the toner image transferred from the photoconductor drum 52 of each color of the second image forming unit 42 and transporting the toner image to a second secondary transfer position T22.

Specifically, the second intermediate transfer belt 72 includes a contact area 72N (nip area) which is in contact with the transport belt 20 in a portion wound around the driving roller 74A. The contact area 72N is the second secondary transfer position T22 at which the toner image on the second intermediate transfer belt 72 is transferred onto the recording medium P. In addition, the second secondary transfer position T22 is an example of a second transfer position.

Further, the second intermediate transfer belt 72 has a function of sandwiching, together with the transport belt 20 in the contact area 72N, the recording medium P which is in a state where the recording medium P is sandwiched between the first intermediate transfer belt 71 and the transport belt 20. In other words, the second intermediate transfer belt 72 has a function of sandwiching the recording medium P together with the transport belt 20 simultaneously with the first intermediate transfer belt 71.

Specifically, in the first exemplary embodiment, when the recording medium P is transported by the transport belt 20, first, the recording medium P is sandwiched between the first intermediate transfer belt 71 and the transport belt 20 and is not sandwiched between the second intermediate transfer belt 72 and the transport belt 20. Then, in the process of being transported by the transport belt 20, the recording medium P is sandwiched between the first intermediate transfer belt 71 and the transport belt 20 and is sandwiched between the second intermediate transfer belt 72 and the transport belt 20. Furthermore, in the process of being transported by the transport belt 20, the recording medium P is not sandwiched between the first intermediate transfer belt 71 and the transport belt 20 and is sandwiched between the second intermediate transfer belt 72 and the transport belt 20. In other words, before the trailing end of the recording medium P leaves the first secondary transfer position T21, the leading end of the recording medium P enters the second secondary transfer position T22.

In the first exemplary embodiment, in a state where the recording medium P of a standard size (for example, A4 size) is sandwiched between the first intermediate transfer belt 71 and the transport belt 20, the second intermediate transfer belt 72 and the transport belt 20 sandwich the recording medium P. The standard size can be said to be the most frequent size. In addition, in a state where the recording medium P of any size (including a recording medium of the smallest size that is transportable by the image forming apparatus 10) is sandwiched between the first intermediate transfer belt 71 and the transport belt 20, the second intermediate transfer belt 72 and the transport belt 20 may sandwich the recording medium P. To describe further, in the first exemplary embodiment, at least in a state where the recording medium P of the largest size that is transportable by the image forming apparatus 10 is sandwiched between the first intermediate transfer belt 71 and the transport belt 20, the second intermediate transfer belt 72 and the transport belt 20 may sandwich the recording medium P.

[Secondary Transfer Rollers 47 and 48]

Each of the two secondary transfer rollers 47 and 48 is disposed on the inner side (inner peripheral side) of the transport belt 20. Specifically, each of the two secondary transfer rollers 47 and 48 is disposed to face a corresponding one of the first intermediate transfer belt 71 and the second intermediate transfer belt 72 via the transport belt 20. More specifically, the secondary transfer roller 47 sandwiches the transport belt 20 and the first intermediate transfer belt 71 together with the driving roller 74A of the first image forming unit 41 in the contact area 71N (first secondary transfer position T21). Further, the secondary transfer roller 48 sandwiches the transport belt 20 and the second intermediate transfer belt 72 together with the driving roller 74A of the second image forming unit 42 in the contact area 72N (second secondary transfer position T22).

Each of the two secondary transfer rollers 47 and 48 has a function of transferring the toner image transferred onto a corresponding one of the first intermediate transfer belt 71 and the second intermediate transfer belt 72 to the recording medium P. In the first exemplary embodiment, by applying a secondary transfer electric field between each of the secondary transfer rollers 47 and 48 and a corresponding one of the driving rollers 74A, the toner image on each of the first intermediate transfer belt 71 and the second intermediate transfer belt 72 is secondarily transferred onto the recording medium P at each of the first secondary transfer position T21 and the second secondary transfer position T22. In addition, in the first exemplary embodiment, the applied voltage which is applied to the secondary transfer roller 48 is, for example, a negative transfer voltage.

(Fixing Device 19)

The fixing device 19 illustrated in FIG. 1 functions as a fixing unit that fixes an image transferred onto a recording medium to the recording medium. Specifically, the fixing device 19 is a device that fixes the toner image transferred onto the recording medium P by the secondary transfer roller 48 to the recording medium P. More specifically, as illustrated in FIG. 1, the fixing device 19 includes the heating roller 92 as a heating member and a pressure roller 94 as a pressure member. The fixing device 19 fixes the toner image formed on the recording medium P to the recording medium P by heating and pressurizing the recording medium P while sandwiching and transporting the recording medium P between the heating roller 92 and the pressure roller 94.

(Arrangement of Components of Image Forming Device 14)

An arrangement of the components of the image forming device 14 will be described. Hereinafter, in particular, an arrangement of the first image forming unit 41 and each component of the first image forming unit 41 and the second image forming unit 42 and each component of the second image forming unit 42 will be described.

As illustrated in FIG. 1, specifically, the first image forming unit 41 is disposed above the accommodating unit 12 at the left side of the transport belt 20. The second image forming unit 42 is disposed above the first image forming unit 41 at the left side of the transport belt 20. Specifically, the first image forming unit 41 and the second image forming unit 42 are disposed to overlap with each other in the vertical direction. In other words, when viewed in the vertical direction, at least a portion of the first image forming unit 41 is disposed to overlap with at least a portion of the second image forming unit 42.

To describe further, the second intermediate transfer belt 72 which is a part of the second image forming unit 42 is disposed above the first intermediate transfer belt 71 which is a part of the first image forming unit 41 to overlap with each other in the vertical direction.

Further, in the first exemplary embodiment, as described above, in a state where the recording medium P of the standard size (for example, A4 size) is sandwiched between the first intermediate transfer belt 71 and the transport belt 20, the second intermediate transfer belt 72 and the transport belt 20 sandwich the recording medium P.

In other words, the first intermediate transfer belt 71 and the second intermediate transfer belt 72 are disposed such that the distance LA (see FIG. 2) between the first secondary transfer position T21 and the second secondary transfer position T22 is shorter than the length of the recording medium P of the standard size along the transport direction.

Further, the distance LA between the first secondary transfer position T21 and the second secondary transfer position T22 is set to be an integral plural (n times) of the circumferential length S of the driving roller 22B around which the transport belt 20 is wound. Specifically, it suffices to satisfy $LA=nS\pm\alpha(0\leq\alpha<S/10)$.

The distance L1 from the first secondary transfer position T21 to the lower end of the contact surface 20A of the transport belt 20 is longer than the distance L5 from the second secondary transfer position T22 to the lower end of the contact surface 20A of the transport belt 20.

The upper end of the first image forming unit 41 overlaps with the second image forming unit 42 when viewed in the horizontal direction (when viewed in the left-and-right direction). In other words, the upper end of the first image forming unit 41 is disposed above (at a position higher than) the lower end of the second image forming unit 42.

Specifically, the first image forming unit 41 includes the power supply board 62 at the upper end, and the upper end of the power supply board 62 overlaps with the second image forming unit 42 when viewed in the horizontal direction. More specifically, the power supply board 62 includes the electronic component 62A at the upper end, and the electronic component 62A overlaps with the second image forming unit 42 when viewed in the horizontal direction. In other words, the electronic component 62A of the power supply board 62 of the first image forming unit 41 is disposed above (at a position higher than) the lower end of the second image forming unit 42. In addition, in FIG. 2, a line extending in the left-and-right direction (horizontal direction) from the upper end of the first image forming unit 41 (the upper end of the electronic component 62A) is indicated by the reference mark H1.

Figure 5:
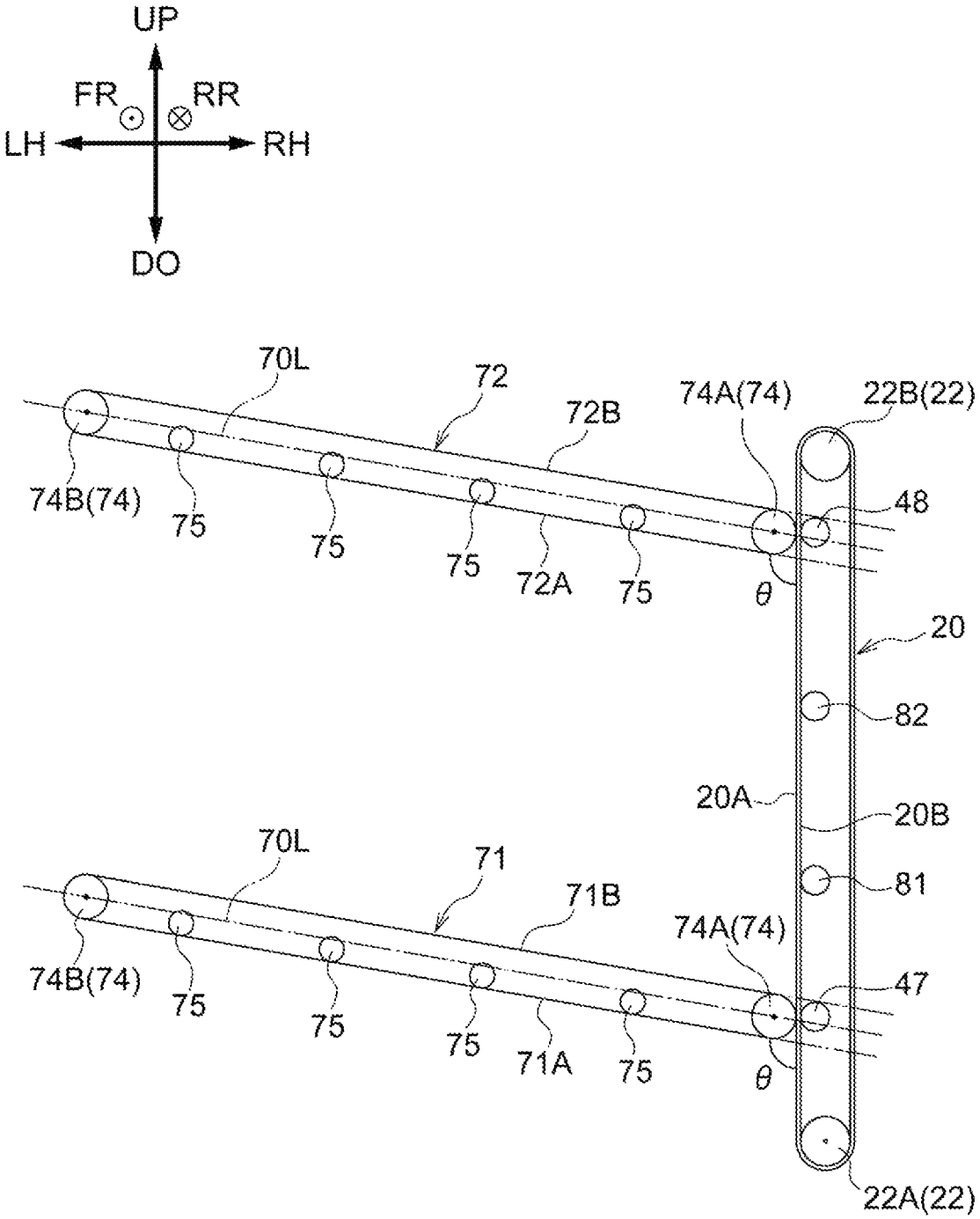
FIG. 5 is a schematic view illustrating a configuration of the transport belt, a first intermediate transfer belt, and a second intermediate transfer belt according to the first exemplary embodiment.

The first intermediate transfer belt 71 and the second intermediate transfer belt 72 are inclined in the same direction with respect to the contact surface 20A of the transport belt 20. Specifically, as illustrated in FIG. 5, both the first intermediate transfer belt 71 and the second intermediate transfer belt 72 are inclined such that the angle θ with respect to the contact surface 20A of the transport belt 20 is an obtuse angle. More specifically, both the first intermediate transfer belt 71 and the second intermediate transfer belt 72 are inclined upward to the left. More specifically, the first intermediate transfer belt 71 and the second intermediate transfer belt 72 are inclined at the same angle.

Here, the reference of the angle of the first intermediate transfer belt 71 and the second intermediate transfer belt 72 is, for example, the angle at a contact surface 71A or 72A (lower surface) which is in contact with the photoconductor drum 52.

In addition, the first intermediate transfer belt 71 and the second intermediate transfer belt 72 are disposed above the respective contact surfaces 71A and 72A, and non-contact surfaces 71B and 72B which are not in contact with each photoconductor drum 52 are disposed along the respective contact surfaces 71A and 72A. Thus, even when the non-contact surfaces 71B and 72B are used as a reference, the angles of the first intermediate transfer belt 71 and the second intermediate transfer belt 72 are grasped as the same angles as the angles of the first intermediate transfer belt 71 and the second intermediate transfer belt 72 when the contact surfaces 71A and 72A are used as a reference.

Furthermore, a line 70L which interconnects the rotation axis of the driving roller 74A and the rotation axis of the driven roller 74B of the first intermediate transfer belt 71 and the second intermediate transfer belt 72 is also disposed along the respective contact surfaces 71A and 72A. Thus, even when the line 70L is used as a reference, the angles of the first intermediate transfer belt 71 and the second intermediate transfer belt 72 are grasped as the same angle as the angles of the first intermediate transfer belt 71 and the second intermediate transfer belt 72 when the contact surfaces 71A and 72A are used as a reference.

The first intermediate transfer belt 71 is disposed above the lower end of the transport belt 20. On the other hand, the upper end of the second intermediate transfer belt 72 is disposed above the upper end of the transport belt 20. Specifically, the upper end of a portion of the second intermediate transfer belt 72 wound around the driven roller 74B is disposed above (at a position higher than) the upper end of a portion of the transport belt 20 wound around the driving roller 22B. In addition, in FIG. 2, a line extending in the left-and-right direction (horizontal direction) from the upper end of the transport belt 20 is indicated by the reference mark H2. Further, in FIGS. 1 and 2, the upper end of the second intermediate transfer belt 72 is indicated by 70U.

Furthermore, the upper end of the second intermediate transfer belt 72 is disposed below the upper end of the fixing device 19 as illustrated in FIG. 1. Specifically, the upper end of a portion of the second intermediate transfer belt 72 wound around the driven roller 74B is disposed below (at a position lower than) the heating roller 92 and the pressure roller 94 of the fixing device 19.

(Charge Applying Rollers 81 and 82)

In the first exemplary embodiment, the contact areas 71N and 72N of the first intermediate transfer belt 71 and the second intermediate transfer belt 72 are in contact with the transport belt 20. Due to the fact that each of the first intermediate transfer belt 71 and the transport belt 20 is a belt member, and therefore, is easily deformed, the recording medium P which has passed through the contact area 71N is easily discharged in a posture in which it is wound around the first intermediate transfer belt 71. Thus, it is necessary to reduce the possibility of the passed recording medium P being separated from the transport belt 20. The charge applying rollers 81 and 82 illustrated in FIG. 2 are an example of a charge applying unit that applies, to the transport belt 20, a charge that attracts the recording medium P to the transport belt 20. The charge applying rollers 81 and 82 are disposed between the first secondary transfer position T21 and the second secondary transfer position T22. Specifically, the charge applying roller 81 is disposed at the lower side between the first secondary transfer position T21 and the second secondary transfer position T22. The charge applying roller 82 is disposed at the upper side between the first secondary transfer position T21 and the second secondary transfer position T22.

Furthermore, the distance L2 between the charge applying roller 81 and the first secondary transfer position T21 is shorter than the distance L4 between the charge applying roller 82 and the second secondary transfer position T22. In other words, it can be said that the charge applying rollers 81 and 82 are closer to the first secondary transfer position T21 than the second secondary transfer position T22. Further, the distance L2 is shorter than the distance L3 between the charge applying rollers 81 and 82. In addition, the distance L3 is the same as the distance L4.

To describe further, the charge applying rollers 81 and 82 are disposed on the inner side (inner peripheral side) of the transport belt 20. Specifically, the charge applying rollers 81 and 82 are disposed on an opposite surface 20B (inner peripheral surface) to the contact surface 20A of the transport belt 20. In other words, the charge applying rollers 81 and 82 are in contact with the opposite surface 20B. The charge applying rollers 81 and 82 are in contact with the opposite surface 20B of the transport belt 20, thus being driven to be rotated by the transport belt 20. That is, the charge applying rollers 81 and 82 can be said to be driven rollers that are driven to be rotated by the transport belt 20.

Then, a voltage is applied between the charge applying rollers 81 and 82 and the secondary transfer roller 47 by, for example, power supplied from the high voltage power supply board 66 of the first image forming unit 41. Thus, the charge which attracts the recording medium P to the transport belt 20 is applied to the transport belt 20 by the charge applying rollers 81 and 82 between the first secondary transfer position T21 and the second secondary transfer position T22, and the recording medium P is attracted to the transport belt 20 by the electrostatic force of the charge.

Here, in the first exemplary embodiment, when the type of the recording medium P selected via the UI 17 connected to the control board 64 of the first image forming unit 41 is the recording medium P having a thickness less than a reference thickness (for example, 0.08 mm), power is supplied to the control board 64 from the high voltage power supply board 66. In other words, when the transport belt 20 transports the recording medium P thinner than the recording medium P having the reference thickness, the transport belt 20 is charged with the charge which attracts the recording medium P to the transport belt 20. Further, when the transport belt 20 transports the recording medium having the reference thickness or more, the charge which attracts the recording medium P to the transport belt 20 is not applied to the transport belt 20.

In addition, the recording medium P having the reference thickness is an example of a first recording medium, and the recording medium P having a thickness less than the reference thickness is an example of a second recording medium.

Further, the recording medium P having the reference thickness may be plain paper. Further, in the first exemplary embodiment, the thickness (mm) of the recording medium is used as a reference of the thickness of the recording medium P, but, for example, the basis weight ($g/m^2$) of the recording medium P may be used. Then, in the first exemplary embodiment, either a positive polarity voltage or a negative polarity voltage is applied as the voltage applied to the charge applying rollers 81 and 82 according to the type of the recording medium P.

Further, in the first exemplary embodiment, power is supplied from the high voltage power supply board 66 of the first image forming unit 41 to the charge applying rollers 81 and 82, but the present disclosure is not limited thereto. For example, the high voltage power supply board 66 of the second image forming unit 42 may be used as a power supply that supplies power to the charge applying rollers 81 and 82. The high voltage power supply board 66 of the first image forming unit 41 may supply power to one of the charge applying rollers 81 and 82, and the high voltage power supply board 66 of the second image forming unit 42 may supply power to the other one of the charge applying rollers 81 and 82. Furthermore, power may be supplied to the charge applying rollers 81 and 82 from a power supply provided in the apparatus body 11 separately from the high voltage power supply board 66 of the first image forming unit 41 and the high voltage power supply board 66 of the second image forming unit 42.

Further, since the charge applying rollers 81 and 82 have a function of assisting the transport of the recording medium P by the transport belt 20, the charge applying rollers 81 and 82 may be grasped as a component that constitutes a part of the transport unit 13.

Operation According to First Exemplary Embodiment

Next, an operation according to the first exemplary embodiment will be described.

According to the image forming apparatus of the first exemplary embodiment, in a state where the first intermediate transfer belt 71 and the transport belt 20 sandwich the recording medium P at the first secondary transfer position T21, the second intermediate transfer belt 72 and the transport belt 20 sandwich the recording medium P at the second secondary transfer position T22.

Here, in relation to a configuration having the first intermediate transfer belt 71 and the second intermediate transfer belt 72, in a configuration (first configuration) in which only a single intermediate transfer belt (only one of the first intermediate transfer belt 71 and the second intermediate transfer belt 72) sandwiches the recording medium P together with the transport belt 20, the first intermediate transfer belt 71 and the second intermediate transfer belt 72 are spaced apart from each other by a distance exceeding the length of the recording medium P in the transport direction. Therefore, the space between the first intermediate transfer belt 71 and the second intermediate transfer belt 72 is increased.

On the other hand, in the first exemplary embodiment, as described above, the recording medium P sandwiched between the first intermediate transfer belt 71 and the transport belt 20 is sandwiched between the second intermediate transfer belt 72 and the transport belt 20. Therefore, the space between the first intermediate transfer belt 71 and the second intermediate transfer belt 72 is reduced compared to the first configuration, and the toner images may be transferred to the recording medium P at plural locations. In other words, according to the configuration of the first exemplary embodiment, it can be said that the distance between the first intermediate transfer belt 71 and the second intermediate transfer belt 72 is reduced compared to the first configuration. Furthermore, in other words, according to the configuration of the first exemplary embodiment, it can be said that the distance between the first secondary transfer position T21 and the second secondary transfer position T22 is reduced compared to the first configuration.

Further, in the first exemplary embodiment, the upper end of the first image forming unit 41 overlaps with the second image forming unit 42 when viewed in the horizontal direction (when viewed in the left-and-right direction). Therefore, compared to a configuration (second configuration) in which the upper end of the first image forming unit 41 is disposed below the lower end of the second image forming unit 42, the distance between the first intermediate transfer belt 71 and the second intermediate transfer belt 72 is reduced. In other words, the space between the first intermediate transfer belt 71 and the second intermediate transfer belt 72 is reduced compared to the second configuration.

Further, in the first exemplary embodiment, the upper end of the power supply board 62 of the first image forming unit 41 overlaps with the second image forming unit 42 when viewed in the horizontal direction. Therefore, compared to a configuration (third configuration) in which the upper end of the power supply board 62 is disposed below the lower end of the second image forming unit 42, the distance between the first intermediate transfer belt 71 and the second intermediate transfer belt 72 is reduced. In other words, the space between the first intermediate transfer belt 71 and the second intermediate transfer belt 72 is reduced compared to the third configuration.

Further, in the first exemplary embodiment, the first intermediate transfer belt 71 and the second intermediate transfer belt 72 are inclined in the same direction with respect to the contact surface 20A of the transport belt 20.

Here, in a configuration (fourth configuration) in which the first intermediate transfer belt 71 and the second intermediate transfer belt 72 are inclined in different directions with respect to the contact surface 20A of the transport belt 20, a dead space tends to occur between the first intermediate transfer belt 71 and the second intermediate transfer belt 72. For example, in a configuration in which the first intermediate transfer belt 71 is inclined obliquely upward to the left, while the second intermediate transfer belt 72 is inclined obliquely upward to the right, a dead space tends to occur in a right region between the first intermediate transfer belt 71 and the second intermediate transfer 72. Further, for example, in a configuration in which the first intermediate transfer belt 71 is inclined obliquely upward to the right, while the second intermediate transfer belt 72 is inclined obliquely upward to the left, a dead space tends to occur in a left region between the first intermediate transfer belt 71 and the second intermediate transfer belt 72. As described above, in the fourth configuration, the dead space tends to occur, and the space between the first intermediate transfer belt 71 and the second intermediate transfer belt 72 tends to be large.

On the other hand, in the first exemplary embodiment, since the first intermediate transfer belt 71 and the second intermediate transfer belt 72 are inclined in the same direction with respect to the contact surface 20A of the transport belt 20, compared to the fourth configuration, a dead space is less likely to occur and the space between the first intermediate transfer belt 71 and the second intermediate transfer belt 72 is reduced.

Further, in the first exemplary embodiment, each of the first intermediate transfer belt 71 and the second intermediate transfer belt 72 is wound around the driving roller 74A which faces the transport belt 20 via the first intermediate transfer belt 71 and the driven roller 74B which is disposed on the opposite side of the driving roller 74A to the transport belt 20.

Therefore, the dimension in the height direction of each of the first intermediate transfer belt 71 and the second intermediate transfer belt 72 is reduced compared to a configuration in which each of the first intermediate transfer belt 71 and the second intermediate transfer belt 72 is wound around three or more rollers. In particular, in the first exemplary embodiment, since the first intermediate transfer belt 71 and the second intermediate transfer belt 72 are disposed obliquely, the dimension in the height direction of the first intermediate transfer belt 71 and the second intermediate transfer belt 72 tends to be large compared to a case where the first intermediate transfer belt 71 and the second intermediate transfer belt 72 are horizontally disposed. Therefore, it is effective to reduce the size in the height direction of each of the first intermediate transfer belt 71 and the second intermediate transfer belt 72 by winding each belt around the driving roller 74A and the driven roller 74B.

Further, in the first exemplary embodiment, the charge applying rollers 81 and 82 apply, to the transport belt 20, a charge that attracts the recording medium P to the transport belt 20 between the first secondary transfer position T21 and the second secondary transfer position T22. The recording medium P is attracted to the transport belt 20 by the electrostatic force of the charge.

Therefore, compared to a configuration (fifth configuration) in which the transport belt 20 transports the recording medium P in a state where no charge is applied to the transport belt between the first secondary transfer position T21 and the second secondary transfer position T22, the recording medium P which has passed the first secondary transfer position T21 is prevented from being separated from the transport belt 20.

In particular, in the first exemplary embodiment, when the transport belt 20 transports the recording medium P thinner than the recording medium P having a reference thickness, the charge which attracts the recording medium P to the transport belt 20 is applied to the transport belt 20. Therefore, the recording medium P thinner than the recording medium P having the reference thickness is prevented from being separated from the transport belt 20 after having passed the first secondary transfer position T21, compared to the fifth configuration. In particular, this configuration is effective since the recording medium P thinner than the recording medium P having the reference thickness is more easily peeled off from the transport belt 20 than the recording medium P having the reference thickness.

Further, in the first exemplary embodiment, the charge applying rollers 81 and 82 are disposed on the opposite surface 20B (inner peripheral surface) to the contact surface 20A of the transport belt 20. Therefore, with respect to the recording medium P transported by the transport belt 20, the recording medium P is attracted to the transport belt 20 in a non-contact manner.

Further, in the first exemplary embodiment, the distance LA between the first secondary transfer position T21 and the second secondary transfer position T22 is an integral plural (n times) of the circumferential length S of the driving roller 22B around which the transport belt 20 is wound.

Therefore, compared to a configuration (sixth configuration) in which the distance between the first secondary transfer position T21 and the second secondary transfer position T22 is different from the integral plural of the circumferential length of the driving roller 22B, a change in the speed of the transport belt 20 due to the eccentricity of the driving roller 22B tends to occur in the same cycle at the first secondary transfer position T21 and the second secondary transfer position T22. Thus, compared to the sixth configuration, transfer deviation between the first secondary transfer position T21 and the second secondary transfer position T22 due to the eccentricity of the driving roller 22B is prevented.

<Modification of Arrangement of First Intermediate Transfer Belt 71 and Second Intermediate Transfer Belt 72>

In the first exemplary embodiment, the first intermediate transfer belt 71 is disposed above the lower end of the transport belt 20 and the upper end of the second intermediate transfer belt 72 is disposed above the upper end of the transport belt 20, but the present disclosure is not limited thereto.

Figure 6:
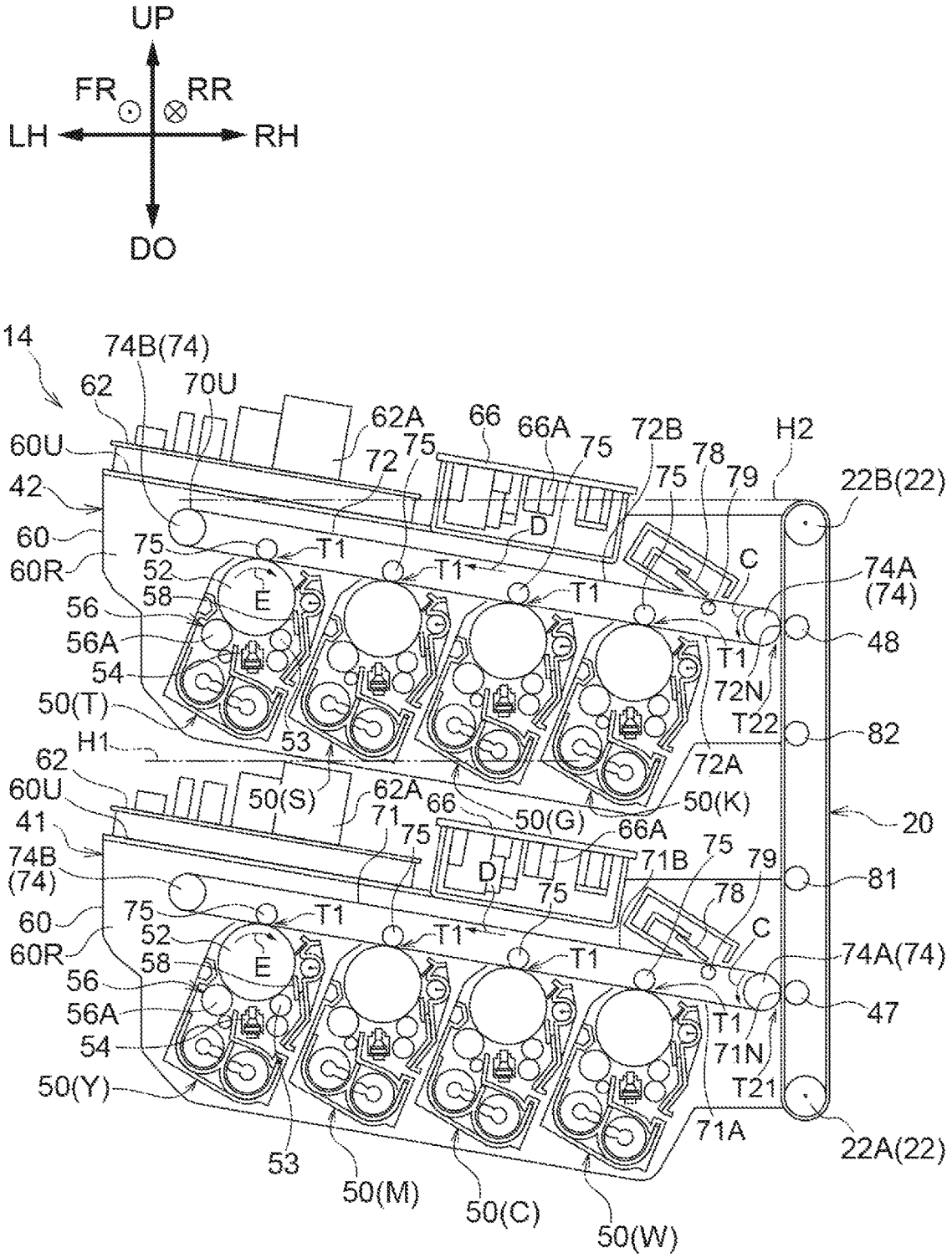
FIG. 6 is a schematic view illustrating an arrangement of a second image forming unit according to a modification.

As illustrated in FIG. 6, for example, the lower end of the first intermediate transfer belt 71 and the upper end of the second intermediate transfer belt 72 may be disposed within the height in the up-and-down direction of the transport belt 20.

That is, the first intermediate transfer belt 71 may be disposed above the lower end of the transport belt 20, and the upper end of the second intermediate transfer belt 72 may be disposed below the upper end of the transport belt 20. In addition, in FIG. 6, a line extending in the left-and-right direction (horizontal direction) from the upper end of the transport belt 20 is indicated by the reference mark H2. Further, in FIG. 6, the upper end of the second intermediate transfer belt 72 is indicated by 70U.

According to the present modification, compared to a configuration (seventh configuration) in which the lower end of the first intermediate transfer belt 71 and the upper end of the second intermediate transfer belt 72 are disposed outside the height in the up-and-down direction of the transport belt 20, the distance between the first intermediate transfer belt 71 and the second intermediate transfer belt 72 is reduced. In other words, the space between the first intermediate transfer belt 71 and the second intermediate transfer belt 72 is reduced compared to the seventh configuration. In addition, in the present modification, the amount by which the upper end of the first image forming unit 41 overlaps with the second image forming unit 42 when viewed in the horizontal direction (when viewed in the left-and-right direction) is increased compared to the configuration illustrated in FIG. 2.

Other Modifications

In the first exemplary embodiment, the upper end of the first image forming unit 41 overlaps with the second image forming unit 42 when viewed in the horizontal direction (when viewed in the left-and-right direction), but the present disclosure is not limited thereto. For example, the upper end of the first image forming unit 41 may be disposed below the lower end of the second image forming unit 42.

Further, in the first exemplary embodiment, the upper end of the power supply board 62 of the first image forming unit 41 overlaps with the second image forming unit 42 when viewed in the horizontal direction, but the present disclosure is not limited thereto. For example, the upper end of the power supply board 62 may be disposed below the lower end of the second image forming unit 42.

Further, in the first exemplary embodiment, the first intermediate transfer belt 71 and the second intermediate transfer belt 72 are inclined at the same angle with respect to the contact surface 20A of the transport belt 20, but the present disclosure is not limited thereto. For example, the first intermediate transfer belt 71 and the second intermediate transfer belt 72 may be inclined at different angles with respect to the contact surface 20A of the transport belt 20.

Further, in the first exemplary embodiment, the first intermediate transfer belt 71 and the second intermediate transfer belt 72 are inclined in the same direction with respect to the contact surface 20A of the transport belt 20, but the present disclosure is not limited thereto. For example, the first intermediate transfer belt 71 and the second intermediate transfer belt 72 may be configured to be inclined in different directions with respect to the contact surface 20A of the transport belt 20. Furthermore, at least one of the first intermediate transfer belt 71 or the second intermediate transfer belt 72 may be disposed in the horizontal direction.

Further, in the first exemplary embodiment, the charge applying rollers 81 and 82 are configured to apply, to the transport belt 20, a charge that attracts the recording medium P to the transport belt 20 between the first secondary transfer position T21 and the second secondary transfer position T22, but the present disclosure is not limited thereto. For example, the transport belt 20 may transport the recording medium P in a state where no charge is applied to the transport belt between the first secondary transfer position T21 and the second secondary transfer position T22.

Further, in the first exemplary embodiment, when the transport belt 20 transports the recording medium P thinner than the recording medium P having a reference thickness, the charge which attracts the recording medium P to the transport belt 20 is applied to the transport belt 20, but the present disclosure is not limited thereto. For example, the charge which attracts the recording medium P to the transport belt 20 may be applied to the transport belt 20 regardless of the thickness of the recording medium P.

Further, in the first exemplary embodiment, a voltage is applied between the charge applying rollers 81 and 82 and the secondary transfer roller 47, but the present disclosure is not limited thereto. For example, a voltage may be applied between the charge applying roller 81 and the charge applying roller 82.

Further, in the first exemplary embodiment, each of the first intermediate transfer belt 71 and the second intermediate transfer belt 72 is wound around the driving roller 74A and the driven roller 74B, but the present disclosure is not limited thereto. For example, each of the first intermediate transfer belt 71 and the second intermediate transfer belt 72 may be wound around three or more rollers.

Further, in the first exemplary embodiment, the distance LA between the first secondary transfer position T21 and the second secondary transfer position T22 is an integral plural (n times) of the circumferential length S of the driving roller 22B around which the transport belt 20 is wound, but the present disclosure is not limited thereto. For example, the distance between the first secondary transfer position T21 and the second secondary transfer position T22 may be different from the integral plural of the circumferential length of the driving roller 22B.

Further, in the first exemplary embodiment, the transport belt 20 transports the recording medium P upward, but the present disclosure is not limited thereto. For example, the transport belt 20 may be configured to transport the recording medium P downward as long as the transport belt transports the recording medium P in the vertical direction.

Further, in the first exemplary embodiment, the first image forming unit 41 includes, as four toner image forming sections 50, the toner image forming sections 50 for total four colors of yellow (Y), magenta (M), cyan (C), and white (W) and the second image forming unit 42 includes, as four toner image forming sections 50, the toner image forming sections 50 for total four colors of transparent (T), silver (S), gold (G), and black (K), but the present disclosure is not limited thereto. For example, a part or all of the toner image forming sections 50 of the colors included in each of the first image forming unit 41 and the second image forming unit 42 may be replaced, and the toner image forming sections 50 of colors other than the above colors may be provided.

Further, in the first exemplary embodiment, each of the first image forming unit 41 and the second image forming unit 42 includes the four toner image forming sections 50, but the present disclosure is not limited thereto. Each of the first image forming unit 41 and the second image forming unit 42 may include two or three toner image forming sections 50 or five or more toner image forming sections 50. That is, each of the first image forming unit 41 and the second image forming unit 42 may have plural toner image forming sections 50.

Further, in the first exemplary embodiment, the image forming device 14 includes two image forming units (the first image forming unit 41 and the second image forming unit 42), but the present disclosure is not limited thereto. The image forming device 14 may further include a third image forming unit, and the image forming device 14 may have three or more image forming units.

Further, in the first exemplary embodiment, the image forming device 14 includes two intermediate transfer belts (the first intermediate transfer belt 71 and the second intermediate transfer belt 72), but the present disclosure is not limited thereto. The image forming device 14 may further have a third intermediate transfer belt, and the image forming device 14 may have three or more intermediate transfer belts.

The present disclosure is not limited to the first exemplary embodiment described above, and various modifications, alterations, and improvements may be made without departing from the scope of the present disclosure. For example, the modifications described above may be combined with each other as appropriate.

<Image Forming Apparatus 110>

Figure 7:
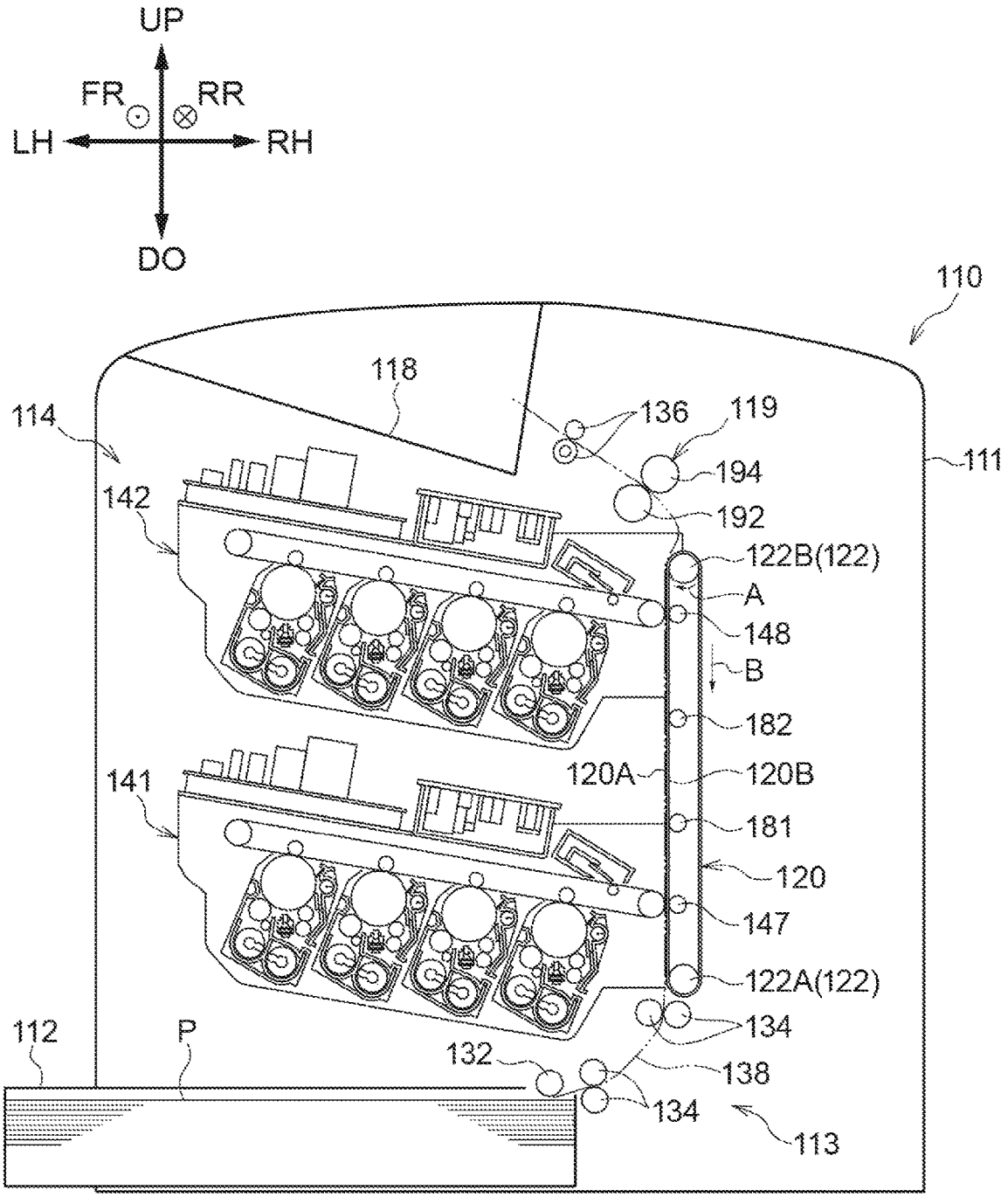
FIG. 7 is a schematic view illustrating a configuration of an image forming apparatus according to a second exemplary embodiment.

A configuration of the image forming apparatus 110 according to a second exemplary embodiment will be described. FIG. 7 is a schematic view illustrating a configuration of the image forming apparatus 110 according to the second exemplary embodiment.

The image forming apparatus 110 illustrated in FIG. 7 is an example of an image forming apparatus that forms an image on a recording medium. Specifically, the image forming apparatus 110 is an electrophotographic image forming apparatus that forms a toner image (an example of an image) on the recording medium P. More specifically, as illustrated in FIG. 7, the image forming apparatus 110 includes an apparatus body 111, an accommodating unit 112, a discharge unit 118, a transport unit 113, an image forming device 114, a fixing device 119, and charge removal rollers 181 and 182. Hereinafter, each unit of the image forming apparatus 110 (the apparatus body 111, the accommodating unit 112, the discharge unit 118, the transport unit 113, the image forming device 114, the fixing device 119, and the charge removal rollers 181 and 182) will be described.

(Apparatus Body 111, Accommodating Unit 112, and Discharge Unit 118)

The apparatus body 111 illustrated in FIG. 7 has a function of accommodating each component therein. The apparatus body 111 is configured with, for example, a box-shaped housing.

The accommodating unit 112 has a function of accommodating the recording medium P such as a sheet. The accommodating unit 112 is provided in a lower portion inside the apparatus body 111 as illustrated in FIG. 7. In the second exemplary embodiment, the recording medium P is accommodated in the accommodating unit 112 by being stacked in the accommodating unit 112.

The discharge unit 118 has a function of discharging the recording medium P on which a toner image has been formed. The discharge unit 118 is provided in an upper region of the apparatus body 111 as illustrated in FIG. 7. In the second exemplary embodiment, the recording medium P discharged toward the discharge unit 118 is stacked on the discharge unit 118.

(Transport Unit 113)

The transport unit 113 illustrated in FIG. 7 has a function of transporting the recording medium P. Specifically, the transport unit 113 has a function of transporting the recording medium P along a transport path 138 extending along the vertical direction. More specifically, the transport unit 113 has a function of transporting the recording medium P upward from the accommodating unit 112 to the discharge unit 118 in the transport path 138.

To describe further, as illustrated in FIG. 7, the transport unit 113 includes a delivery roller 132, plural transport rollers 134, a transport belt 120, and a discharge roller 136. The delivery roller 132 is a roller that delivers the recording medium P accommodated in the accommodating unit 112. The plural transport rollers 134 are rollers that transport the recording medium P delivered by the delivery roller 132 toward the transport belt 120.

The transport belt 120 is disposed along the transport path 138 extending along the vertical direction. The transport belt 120 has a function of transporting the recording medium P by coming into contact with one surface of the recording medium P.

Specifically, the transport belt 120 takes the shape of a band having a width in the front-and-rear direction, and is formed in an annular shape. More specifically, the transport belt 120 is formed, for example, in an endless shape having no end.

To describe further, the transport belt 120 is wound around a pair of rollers 122. Specifically, the transport belt 120 is wound in a state where tension is applied to the pair of rollers 122 spaced apart from each other by a distance in the up-and-down direction (vertical direction). More specifically, the transport belt 120 is wound in a state where tension is applied to a driven roller 122A disposed at the lower portion inside the apparatus body 111 and a driving roller 122B disposed above the driven roller 122A as the pair of rollers 122. In the second exemplary embodiment, when the driving roller 122B is rotated in one direction (the direction of the arrow A) by a drive source (not illustrated), the transport belt 120 circulates in one direction (the direction of the arrow B).

To describe further, the transport belt 120 has a function of transporting the recording medium P by coming into contact at the outer peripheral surface thereof with a non-image surface of the recording medium P. Specifically, the transport belt 120 comes into contact with the non-image surface of the recording medium P at a contact surface 120A facing the left side (the side of a first intermediate transfer belt 171 and a second intermediate transfer belt 172 to be described later) of the outer peripheral surface to transport the recording medium P. More specifically, the transport belt 120 electrostatically attracts the non-image surface of the recording medium P to the contact surface 120A to transport the recording medium P. In addition, specifically, the contact surface 120A is a surface extending linearly along the vertical direction. Further, the non-image surface of the recording medium P is the surface opposite to an image surface on which a toner image is formed. As described above, in the second exemplary embodiment, the transport belt 120 is configured to transport the recording medium P from the lower side to the upper side in the gravitational direction.

The discharge roller 136 is a roller that discharges the recording medium P which has passed through the fixing device 119 after transported by the transport belt 120 to the discharge unit 118.

As described above, the transport unit 113 transports the recording medium P upward. Thus, in the transport unit 113, the upward direction is taken as a transport direction. Further, in the transport unit 113, the lower side is the upstream side in the transport direction, and the upper side is the downstream side in the transport direction.

(Image Forming Device 114)

The image forming device 114 illustrated in FIG. 7 has a function of forming a toner image (an example of an image) on the recording medium P. Specifically, as illustrated in FIG. 7, the image forming device 114 includes a first image forming unit 141, a second image forming unit 142, and two secondary transfer rollers 147 and 148.

Hereinafter, a configuration of the first image forming unit 141, the second image forming unit 142, and the two secondary transfer rollers 147 and 148 will be described.

[First Image Forming Unit 141]

As illustrated in FIG. 7, the first image forming unit 141 is provided in a lower portion inside the apparatus body 111. Specifically, the first image forming unit 141 is disposed above the accommodating unit 112 at the left side of the transport belt 120.

Figure 8:
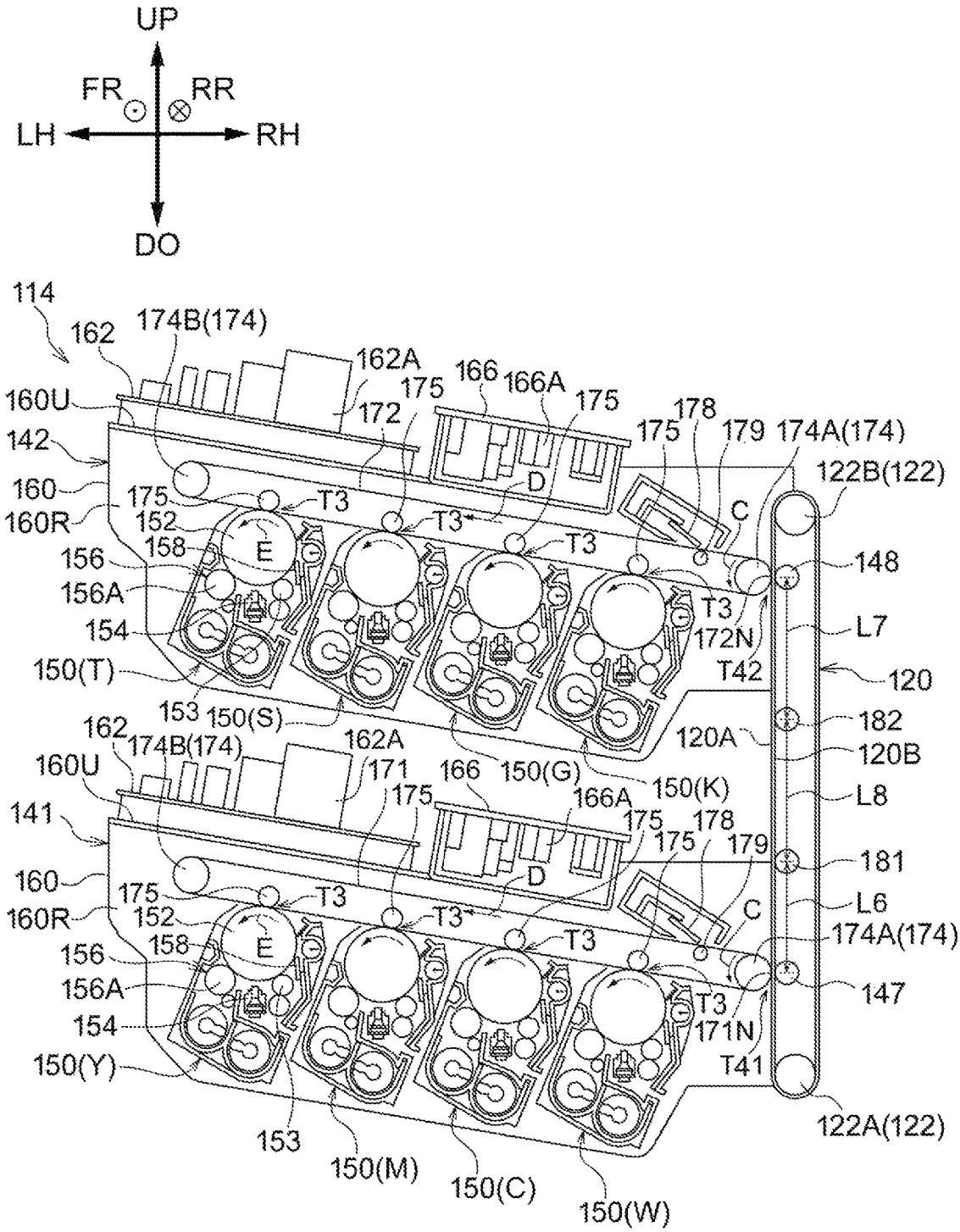
FIG. 8 is a schematic view illustrating a configuration of a transport belt, a first image forming unit, and a second image forming unit according to the second exemplary embodiment.
Figure 9:
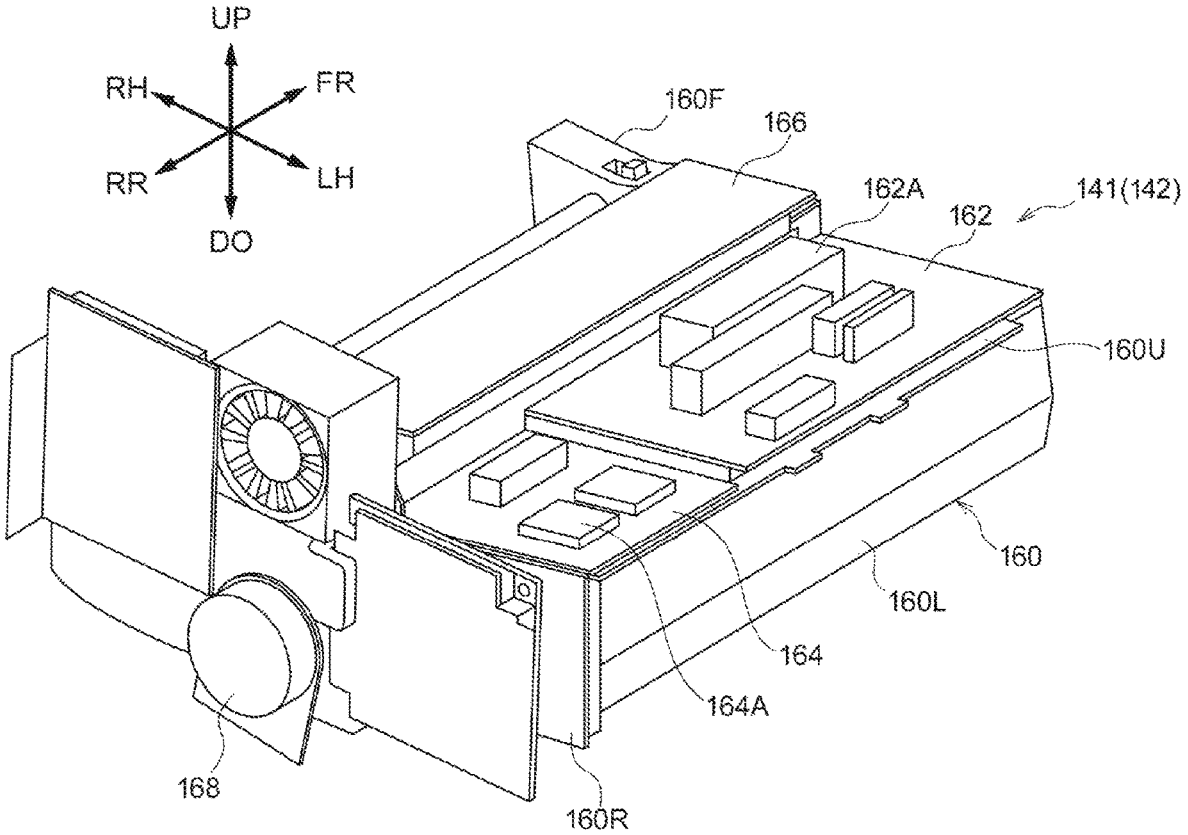
FIG. 9 is a perspective view illustrating a configuration of the first image forming unit (second image forming unit) according to the second exemplary embodiment.

The first image forming unit 141, as illustrated in FIGS. 8 and 9, includes a unit body 160, four toner image forming sections 150, four primary transfer rollers 175, the first intermediate transfer belt 171, a motor 168, a power supply board 162, a control board 164, and a high voltage power supply board 166.

Specifically, the first image forming unit 141 includes, as the four toner image forming sections 150, toner image forming sections 150 for total four colors of yellow (Y), magenta (M), cyan (C), and white (W). The reference characters "Y", "M", "C", and "W" illustrated in FIG. 8 indicate components corresponding to the respective colors. Further, since the toner image forming sections 150 of the respective colors are configured in the same manner except for a toner, on behalf of the toner image forming section 150 of each color, the reference numeral is given to each component of the toner image forming section 150(Y) in FIG. 8. Hereinafter, each component of the first image forming unit 141 (the unit body 160, the four toner image forming sections 150, the four primary transfer rollers 175, the first intermediate transfer belt 171, the motor 168, the power supply board 162, the control board 164, and the high voltage power supply board 166) will be described.

[Unit Body 160]

The unit body 160 illustrated in FIG. 9 functions as a support body that supports each component of the first image forming unit 141. The unit body 160 is configured with, for example, a frame formed of a sheet metal. The unit body 160 includes, for example, an upper wall 160U, a front wall 160F, a rear wall 160R, and a left wall 160L (side wall), as illustrated in FIG. 9. In addition, in FIG. 8, the front wall 160F and the left wall 160L (side wall) are omitted.

[Toner Image Forming Section 150]

As illustrated in FIG. 8, the toner image forming section 150 of each color includes a photoconductor drum 152 (photoconductor) which rotates in one direction (the direction of the arrow E). Furthermore, the toner image forming section 150 of each color includes a charging device 153, an exposure device 154, a developing device 156, and a removing device 158.

In the toner image forming section 150 of each color, the charging device 153 charges the photoconductor drum 152. Furthermore, the exposure device 154 exposes the photoconductor drum 152 charged by the charging device 153 to form an electrostatic latent image on the photoconductor drum 152. Further, the developing device 156 develops the electrostatic latent image formed on the photoconductor drum 152 by the exposure device 154 to form a toner image. The removing device 158 is configured with a blade which removes the toner remaining on the photoconductor drum 152 after the toner image is transferred onto the first intermediate transfer belt 171 to be described later.

[Primary Transfer Roller 175]

The four primary transfer rollers 175 are disposed on the inner side (inner peripheral side) of the first intermediate transfer belt 171, as illustrated in FIG. 8. Specifically, each of the four primary transfer rollers 175 is disposed to face the photoconductor drum 152 of a corresponding color via the first intermediate transfer belt 171.

Each primary transfer roller 175 has a function of transferring the toner image on the photoconductor drum 152 of a corresponding color onto the first intermediate transfer belt 171 at a primary transfer position T3 between the photoconductor drum 152 and the primary transfer roller 175. In the second exemplary embodiment, by applying a primary transfer electric field between the primary transfer roller 175 and the photoconductor drum 152, the toner image formed on the photoconductor drum 152 is transferred onto the first intermediate transfer belt 171 at the primary transfer position T3. In this way, the toner images on the photoconductor drums 152 of the respective colors are primarily transferred onto the first intermediate transfer belt 171 in an overlapping manner.

[First Intermediate Transfer Belt 171]

The first intermediate transfer belt 171 has a function of transporting the toner image transferred from the photoconductor drum 152 of each color of the first image forming unit 141 to a first secondary transfer position T41 to be described later. Specifically, the first intermediate transfer belt 171 is configured as follows.

The first intermediate transfer belt 171 takes the shape of a band having a width in the front-and-rear direction, and is formed in an annular shape. Specifically, the first intermediate transfer belt 171 is formed, for example, in an endless shape having no end.

To describe further, the first intermediate transfer belt 171 is wound around a pair of rollers 174. Specifically, the first intermediate transfer belt 171 is wound around the pair of rollers 174 spaced apart from each other by a distance in the left-and-right direction in a tensioned state. More specifically, the first intermediate transfer belt 171 is wound around, as the pair of rollers 174, a driving roller 174A disposed in a right region (on the transport belt 120 side) inside the apparatus body 111 and a driven roller 174B disposed at the left side of the driving roller 174A (on the opposite side of the driving roller 174A to the transport belt 120) in a tensioned state. In the second exemplary embodiment, when the driving roller 174A is rotated by the motor 168 in one direction (the direction of the arrow C), the first intermediate transfer belt 171 circulates in one direction (the direction of the arrow D). In addition, the driving roller 174A functions as an opposing roller (backup roller) of the secondary transfer roller 148.

The first intermediate transfer belt 171 has a contact area 171N (nip area) which is in contact with the transport belt 120 in a portion thereof wound around the driving roller 174A. The contact area 171N is the first secondary transfer position T41 at which the toner image on the first intermediate transfer belt 171 is transferred onto the recording medium P. Further, the first intermediate transfer belt 171 sandwiches and transports the recording medium P together with the transport belt 120 in the contact area 171N. The first secondary transfer position T41 is an example of a first transfer position.

In addition, the first image forming unit 141 includes a removing unit 178 which removes the toner remaining on the first intermediate transfer belt 171 after the toner image is transferred onto the recording medium P. The removing unit 178 is configured with a blade disposed between the high voltage power supply board 166 and the transport belt 120 at the upper side of the first intermediate transfer belt 171. An opposing roller 179 is provided below the removing unit 178 to face the removing unit 178 via the first intermediate transfer belt 171.

[Motor 168]

The motor 168 is provided on the rear wall 160R of the unit body 160 in the first image forming unit 141, as illustrated in FIG. 9. The motor 168 functions as a drive source which drives a driving component of the first image forming unit 141. Specifically, the motor 168 drives, for example, the photoconductor drum 152, a developing roller 156A of the developing device 156, and the driving roller 174A around which the first intermediate transfer belt 171 is wound via a gear train (not illustrated). Furthermore, the drive force of the motor 168 is transmitted to, for example, the delivery roller 132 and the plural transport rollers 134 of the transport unit 113 so that the delivery roller 132 and the plural transport rollers 134 are driven to rotate.

[Power Supply Board 162, Control Board 164, and High Voltage Power Supply Board 166]

The power supply board 162, the control board 164, and the high voltage power supply board 166 are provided on the top of the unit body 160, as illustrated in FIGS. 8 and 9.

The power supply board 162 has a function of receiving power supplied from an external power supply (not illustrated) of the image forming apparatus 110 via an electric wire (not illustrated) and supplying power of a predetermined voltage to the motor 168 or the like. The power supply board 162 includes an electronic component 162A on the upper surface thereof.

The control board 164 has a function of controlling the driving of each component of the first image forming unit 141. The control board 164 includes a recording unit which is configured with, for example, a ROM or a storage in which a program is recorded and a processor which operates according to a program. The control board 164 includes an electronic component 164A on the upper surface thereof.

Figure 10:
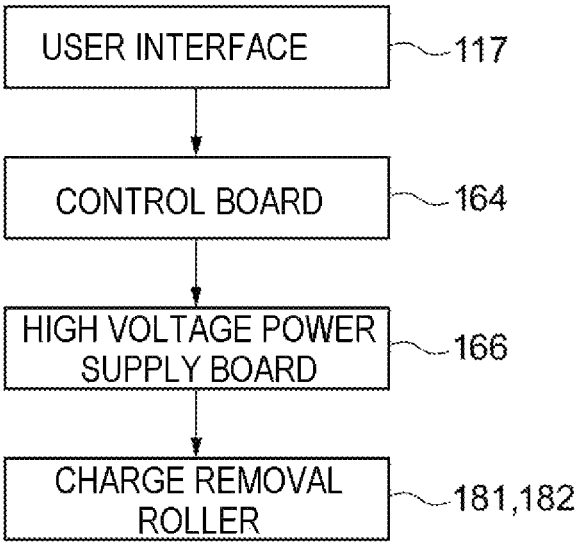
FIG. 10 is a schematic view illustrating a control system which controls an operation of a charge removal roller according to the second exemplary embodiment.

As illustrated in FIG. 10, a user interface 117 (hereinafter referred to as UI 117) as an operation unit is connected to the control board 164. The UI 117 is configured with, for example, a liquid crystal display with a touch panel. An operation button (virtual button) and information to be notified to an operator (user) are displayed on the screen of the UI.

The operator operates the operation button via the UI 117 to specify an image forming condition including selection of the type of the recording medium P. In addition, the operation unit may be, for example, a personal computer (PC) connected to the image forming apparatus 110 via a network as long as the operation unit is capable of specifying the image forming condition.

The high voltage power supply board 166 has a function of receiving power supplied from an external power supply (not illustrated) of the image forming apparatus 110 via an electric wire (not illustrated) and supplying power of a voltage higher than the voltage of the power supply board 162 to the charging device 153, the developing device 156, the four primary transfer rollers 175, the secondary transfer rollers 147 and 148, the charge removal rollers 181 and 182, and the like. The high voltage power supply board 166 includes an electronic component 166A on the lower surface thereof. In addition, the high voltage power supply board 166 may be configured to receive power supplied from the power supply board 162.

[Second Image Forming Unit 142]

The second image forming unit 142 is provided in an upper region inside the apparatus body 111. Specifically, the second image forming unit 142 is disposed above the first image forming unit 141 at the left side of the transport belt 120. Further, the second image forming unit 142 is disposed to overlap with the first image forming unit 141 in the vertical direction.

In the second exemplary embodiment, the second image forming unit 142 is configured in the same manner as the first image forming unit 141. Specifically, the second image forming unit 142 includes the unit body 160, the four toner image forming sections 150, the four primary transfer rollers 175, the second intermediate transfer belt 172, the motor 168, the power supply board 162, the control board 164, and the high voltage power supply board 166.

The second image forming unit 142 includes, as the four toner image forming sections 150, toner image forming sections 150 for total four colors of transparent (T), silver (S), gold (G), and black (K). The reference characters "T", "S", "G", and "K" illustrated in FIG. 8 indicate components corresponding to the respective colors. Further, since the toner image forming sections 150 of the respective colors are configured in the same manner except for the toner to be used, on behalf of the toner image forming section 150 of each color, the reference numeral is given to each component of the toner image forming section 150(T) in FIG. 8. Further, since the toner image forming section 150 of the second image forming unit 142 is configured in the same manner as the toner image forming section 150 of the first image forming unit 141, a description thereof will be omitted.

Further, since each of the unit body 160, the four primary transfer rollers 175, the power supply board 162, the control board 164, and the high voltage power supply board 166 in the second image forming unit 142 is configured in the same manner as each of the unit body 160, the four primary transfer rollers 175, the power supply board 162, the control board 164, and the high voltage power supply board 166 in the first image forming unit 141, a description thereof will be omitted.

The motor 168 in the second image forming unit 142 drives, for example, the photoconductor drum 152, the developing roller 156A of the developing device 156, and the driving roller 174A around which the second intermediate transfer belt 172 is wound, for example, via a gear train (not illustrated). Furthermore, the drive force of the motor 168 is transmitted to, for example, the driving roller 122B of the transport belt 120 and a heating roller 192 of the fixing device 119 to be described later so that the driving roller 122B and the heating roller 192 are driven to rotate. In addition, the same reference numeral is appropriately given to each component of the second image forming unit 142 having the same function as each component of the first image forming unit 141.

[Second Intermediate Transfer Belt 172]

The second intermediate transfer belt 172 is configured in the same manner as the first intermediate transfer belt 171 of the first image forming unit 141. The second intermediate transfer belt 172 has a function of transporting the toner image transferred from the photoconductor drum 152 of each color of the second image forming unit 142 to a second secondary transfer position T42.

Specifically, the second intermediate transfer belt 172 includes a contact area 172N (nip area) which is in contact with the transport belt 120 in a portion wound around the driving roller 174A. The contact area 172N is the second secondary transfer position T42 at which the toner image on the second intermediate transfer belt 172 is transferred onto the recording medium P. In addition, the second secondary transfer position T42 is an example of a second transfer position.

Further, the second intermediate transfer belt 172 has a function of sandwiching, together with the transport belt 120 in the contact area 172N, the recording medium P which is in a state where the recording medium is sandwiched between the first intermediate transfer belt 171 and the transport belt 120. In other words, the second intermediate transfer belt 172 has a function of sandwiching the recording medium P together with the transport belt 120 simultaneously with the first intermediate transfer belt 171.

To describe further, the second intermediate transfer belt 172 and the first intermediate transfer belt 171 vertically overlap with each other in the gravitational direction. Specifically, the second intermediate transfer belt 172 is disposed above the first intermediate transfer belt 171 to overlap with the first intermediate transfer belt 171 in the gravitational direction.

[Secondary Transfer Rollers 147 and 148]

Each of the two secondary transfer rollers 147 and 148 is disposed on the inner side (inner peripheral side) of the transport belt 120. Specifically, each of the two secondary transfer rollers 147 and 148 is disposed to face a corresponding one of the first intermediate transfer belt 171 and the second intermediate transfer belt 172 via the transport belt 120. More specifically, the secondary transfer roller 147 sandwiches the transport belt 120 and the first intermediate transfer belt 171 together with the driving roller 174A of the first image forming unit 141 in the contact area 171N (first secondary transfer position T41). Further, the secondary transfer roller 148 sandwiches the transport belt 120 and the second intermediate transfer belt 172 together with the driving roller 174A of the second image forming unit 142 in the contact area 172N (second secondary transfer position T42).

Each of the two secondary transfer rollers 147 and 148 has a function of transferring the toner image transferred onto a corresponding one of the first intermediate transfer belt 171 and the second intermediate transfer belt 172 to the recording medium P. In the second exemplary embodiment, by applying a secondary transfer electric field between each of the secondary transfer rollers 147 and 148 and a corresponding one of the driving rollers 174A, the toner image on each of the first intermediate transfer belt 171 and the second intermediate transfer belt 172 is secondarily transferred onto the recording medium P at each of the first secondary transfer position T41 and the second secondary transfer position T42. In addition, in the second exemplary embodiment, the applied voltage which is applied to the secondary transfer roller 148 is, for example, a negative transfer voltage.

(Fixing Device 119)

The fixing device 119 illustrated in FIG. 7 functions as a fixing unit that fixes an image transferred onto a recording medium to the recording medium. Specifically, the fixing device 119 is a device that fixes the toner image transferred onto the recording medium P by the secondary transfer roller 148 to the recording medium P. More specifically, as illustrated in FIG. 7, the fixing device 119 includes the heating roller 192 as a heating member and a pressure roller 194 as a pressure member. The fixing device 119 fixes the toner image formed on the recording medium P to the recording medium P by heating and pressurizing the recording medium P while sandwiching and transporting the recording medium P between the heating roller 192 and the pressure roller 194.

(Charge Removal Rollers 181 and 182)

The charge removal rollers 181 and 182 illustrated in FIG. 8 is an example of a charge removal unit that removes the charge of the recording medium P charged at the first secondary transfer position T41. The charge removal rollers 181 and 182 are disposed between the first secondary transfer position T41 and the second secondary transfer position T42. Specifically, the charge removal roller 181 is disposed at the lower side between the first secondary transfer position T41 and the second secondary transfer position T42. The charge removal roller 182 is disposed at the upper side between the first secondary transfer position T41 and the second secondary transfer position T42.

Furthermore, the distance L6 between the charge removal roller 181 and the first secondary transfer position T41 is shorter than the distance L7 between the charge removal roller 182 and the second secondary transfer position T42. In other words, it can be said that the charge removal rollers 181 and 182 are closer to the first secondary transfer position T41 than the second secondary transfer position T42. Further, the distance L6 is shorter than the distance L8 between the charge removal rollers 181 and 182. In addition, the distance L7 is the same as the distance L8.

To describe further, the charge removal rollers 181 and 182 are disposed on the inner side (inner peripheral side) of the transport belt 120. Specifically, the charge removal rollers 181 and 182 are disposed on an opposite surface 120B (an example of the inner peripheral surface) to the contact surface 120A of the transport belt 120. In other words, the charge removal rollers 181 and 182 are in contact with the opposite surface 120B.

The charge removal rollers 181 and 182 are in contact with the opposite surface 120B of the transport belt 120, thus being driven to be rotated by the transport belt 120. That is, the charge removal rollers 181 and 182 are driven rollers that are driven to be rotated by the transport belt 120.

Then, a voltage is applied between the charge removal rollers 181 and 182 and the secondary transfer roller 147 by, for example, power supplied from the high voltage power supply board 166 of the first image forming unit 141. As described above, the charge removal rollers 181 and 182 are configured to remove the charge of the recording medium P by applying charge having an opposite polarity to that of the recording medium P charged at the first secondary transfer position T41 when the voltage is applied thereto.

As described above, since the charge removal rollers 181 and 182 are in contact with the opposite surface 120B of the transport belt 120, in the second exemplary embodiment, the charge of the recording medium P is removed by the charge removal rollers 181 and 182 via the transport belt 120.

In addition, "charge removal" means removing (neutralizing) at least a part of the charge of the charged recording medium P and is not limited to completely removing the charge. That is, it suffices that the amount of charge of the recording medium P is reduced so that electrostatic force is reduced. Then, in the second exemplary embodiment, either a positive polarity voltage or a negative polarity voltage is applied as the voltage applied to the charge removal rollers 181 and 182 according to the type of the recording medium P.

(Driving Control of Charge Removal Rollers 181 and 182)

In the second exemplary embodiment, the control board 164 as an example of a receiving unit that receives information on the recording medium P changes the voltage applied to the charge removal rollers 181 and 182 based on the received information on the recording medium P. Specifically, for example, the control board 164 of the first image forming unit 141 receives type information on the recording medium P, and the control board 164 drives and controls the high voltage power supply board 166 based on the type information on the recording medium P, and changes the voltage applied to the charge removal rollers 181 and 182 (see FIG. 10).

The type information on the recording medium P is an example of information on the recording medium P, and is information indicating the type of the recording medium P. The type information on the recording medium P is received by the control board 164 of the first image forming unit 141, for example, by the type of the recording medium P being selected via the UI 117. In addition, the type information on the recording medium P may be received from an external device connected to the image forming apparatus 110. Furthermore, the type of the recording medium P may be detected by a sensor, for example, and the result may be received as the type information on the recording medium P.

Then, for example, when the received type information indicates that the type of the recording medium P is a first type, the control board 164 applies a first voltage to the charge removal rollers 181 and 182, and when the received type information indicates that the type of the recording medium P is a second type in which resistance is higher than that in the first type, the control board 164 applies a second voltage higher than the first voltage to the charge removal rollers 181 and 182. Thus, the amount of charge of the charge removal rollers 181 and 182 is increased to increase the charge removal capability thereof.

In other words, for example, when the received type information indicates that the type of the recording medium P is a high resistance type having high resistance, the control board 164 increases the voltage applied to the charge removal rollers 181 and 182.

In addition, in the second exemplary embodiment, power is supplied from the high voltage power supply board 166 of the first image forming unit 141 to the charge removal rollers 181 and 182, but the present disclosure is not limited thereto. For example, the high voltage power supply board 166 of the second image forming unit 142 may be used as a power supply that supplies power to the charge removal rollers 181 and 182. The high voltage power supply board 166 of the first image forming unit 141 may supply power to one of the charge removal rollers 181 and 182, and the high voltage power supply board 166 of the second image forming unit 142 may supply power to the other one of the charge removal rollers 181 and 182. Furthermore, power may be supplied to the charge removal rollers 181 and 182 from a power supply provided in the apparatus body 111 separately from the high voltage power supply board 166 of the first image forming unit 141 and the high voltage power supply board 166 of the second image forming unit 142.

Operation According to Second Exemplary Embodiment

Next, an operation according to the second exemplary embodiment will be described.

In the second exemplary embodiment, by applying a secondary transfer electric field between the secondary transfer roller 147 and the driving roller 174A of the first intermediate transfer belt 171, the toner image is transferred from the first intermediate transfer belt 171 to the recording medium P transported upward by the transport belt 120 at the first secondary transfer position T41. At this time, the recording medium P is charged.

The recording medium P charged at the first secondary transfer position T41 is further transported upward by the transport belt 120, and the charge of the recording medium is removed by the charge removal rollers 181 and 182 between the first secondary transfer position T41 and the second secondary transfer position T42. The recording medium P, the charge of which has been removed by the charge removal rollers 181 and 182, is further transported upward by the transport belt 120, and by applying a secondary transfer electric field between the secondary transfer roller 148 and the driving roller 174A of the second intermediate transfer belt 172, the toner image is transferred from the second intermediate transfer belt 172 to the recording medium at the second secondary transfer position T42.

As described above, in the second exemplary embodiment, since the charge of the recording medium P is removed by the charge removal rollers 181 and 182, compared to a configuration in which the recording medium P is transported to the second secondary transfer position T42 while being in a charged state at the first secondary transfer position T41, the occurrence of influence on the transferability of the toner image at the second secondary transfer position T42 is prevented.

Further, in the second exemplary embodiment, the charge removal rollers 181 and 182 are disposed inside the transport belt 120, and the charge of the recording medium P is removed via the transport belt 120. Therefore, with respect to the recording medium P transported by the transport belt 120, the charge removal rollers 181 and 182 remove the charge of the recording medium P in a non-contact manner. As described above, since the charge removal rollers 181 and 182 are not in contact with the recording medium P, deviation of the recording medium P from the transport belt 120 or wrinkles of the recording medium P are further prevented, compared to a configuration in which the charge removal rollers 181 and 182 are in contact with the recording medium.

Further, in the second exemplary embodiment, the charge removal rollers 181 and 182 are driven rollers that are in contact with the opposite surface 120B of the transport belt 120 and are driven to be rotated by the transport belt 120. Therefore, compared to a configuration in which the charge removal rollers 181 and 182 slide relatively to the transport belt 120, frictional resistance with the transport belt 120 is reduced. In addition, "slide" means a state of moving with a gliding motion.

Further, in the second exemplary embodiment, the transport belt 120 transports the recording medium P upward, and the second intermediate transfer belt 172 and the first intermediate transfer belt 171 overlap vertically in the gravitational direction. Therefore, compared to a configuration in which the transport belt 120 transports the recording medium P in the horizontal direction and the entire first intermediate transfer belt 171 is disposed offset with respect to the second intermediate transfer belt 172 in the horizontal direction, the dimension in the horizontal direction of the image forming apparatus 110 is reduced and the occurrence of influence on the transferability of the toner image at the second secondary transfer position T42 is prevented.

Further, in the second exemplary embodiment, the charge removal rollers 181 and 182 are configured to remove the charge of the recording medium P by applying charge having an opposite polarity to that of the recording medium P charged at the first secondary transfer position T41 when a voltage is applied thereto. Therefore, the charge removal capability of the charge removal rollers 181 and 182 is increased, compared to a configuration in which the charge removal rollers 181 and 182 are grounded to a reference potential (ground) and function as an earth that simply releases the charge of the recording medium P.

Further, in the second exemplary embodiment, the control board 164 drives and controls the high voltage power supply board 166 based on the type information on the recording medium P to change the voltage applied to the charge removal rollers 181 and 182. Therefore, compared to a configuration in which a constant voltage is applied to the charge removal rollers 181 and 182, the charge removal capability of the charge removal rollers 181 and 182 is changed according to the recording medium P.

Modifications

In the second exemplary embodiment, the charge removal rollers 181 and 182 are disposed on the inner side (inner peripheral side) of the transport belt 120, but the present disclosure is not limited thereto. For example, the charge removal rollers 181 and 182 may be disposed in the space between the first image forming unit 141 and the second image forming unit 142 outside the transport belt 120. In this configuration, a charge removal unit other than the charge removal rollers 181 and 182 is disposed, for example, on the contact surface 120A side of the transport belt 120 between the first secondary transfer position T41 and the second secondary transfer position T42. In this case, it is necessary to remove the charge of the recording medium P without disturbing the toner image transferred from the first image forming unit 141. Thus, specifically, the charge removal unit is disposed to face the contact surface 120A in a non-contact manner, and it is necessary to form an electrical path from the end of the transport belt 120 intersecting with the traveling direction of the transport belt 120 to the inner surface of the transport belt so that a path for charge removal is formed on the inner surface of the transport belt 120.

Further, in the second exemplary embodiment, the charge removal rollers 181 and 182 are driven rollers that are in contact with the opposite surface 120B of the transport belt 120 and are driven to be rotated by the transport belt 120, but the present disclosure is not limited thereto. The charge removal rollers 181 and 182 may be configured to slide relatively to, for example, the transport belt 120 which circulates. An example of the charge removal unit in this configuration means a charge removal needle (Detack saw), a charge removal film, or the like.

Further, in the second exemplary embodiment, a voltage is applied between the charge removal rollers 181 and 182 and the secondary transfer roller 147, but the present disclosure is not limited thereto. For example, a voltage may be applied between the charge removal roller 181 and the charge removal roller 182.

Further, in the second exemplary embodiment, the transport belt 120 transports the recording medium P upward, but the present disclosure is not limited thereto. For example, the transport belt 120 may be configured to transport the recording medium P downward. Further, the transport belt 120 may be configured to transport the recording medium P in the horizontal direction.

Further, in the second exemplary embodiment, the control board 164 changes the voltage applied to the charge removal rollers 181 and 182 based on the type information on the recording medium P, but the present disclosure is not limited thereto. For example, a constant voltage may be applied to the charge removal rollers 181 and 182.

Further, in the second exemplary embodiment, the voltage is applied to the charge removal rollers 181 and 182, but the present disclosure is not limited thereto. For example, the charge removal rollers 181 and 182 may be grounded to a reference potential (ground) and may function as an earth that releases charge of the charged recording medium P, and it may be necessary for the charge removal unit to remove at least a part of the charge of the charged recording medium P.

Further, in the second exemplary embodiment, the first image forming unit 141 includes, as four toner image forming sections 150, the toner image forming sections 150 for total four colors of yellow (Y), magenta (M), cyan (C), and white (W) and the second image forming unit 142 includes, as four toner image forming sections 150, the toner image forming sections 150 for total four colors of transparent (T), silver (S), gold (G), and black (K), but the present disclosure is not limited thereto. For example, a part or all of the toner image forming sections 150 of the colors included in each of the first image forming unit 141 and the second image forming unit 142 may be replaced, and the toner image forming sections 150 of colors other than the above colors may be provided.

Further, in the second exemplary embodiment, each of the first image forming unit 141 and the second image forming unit 142 includes the four toner image forming sections 150, but the present disclosure is not limited thereto. Each of the first image forming unit 141 and the second image forming unit 142 may include two or three toner image forming sections 150 or five or more toner image forming sections 150. That is, each of the first image forming unit 141 and the second image forming unit 142 may have plural toner image forming sections 150.

Further, in the second exemplary embodiment, the image forming device 114 includes two image forming units (the first image forming unit 141 and the second image forming unit 142), but the present disclosure is not limited thereto. The image forming device 114 may further include a third image forming unit, and the image forming device 114 may have three or more image forming units.

The present disclosure is not limited to the above-described second exemplary embodiment, and various modifications, changes, and improvements may be made without departing from the scope of the present disclosure. For example, the modifications described above may be combined with each other as appropriate.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

plural image forming bodies each comprising plural image forming sections, and a primary intermediate transfer body onto which images formed by the plural image forming sections are primarily transferred;

plural secondary transfer units provided on the plural image forming bodies, respectively, the secondary transfer units being configured to sequentially and secondarily transfer the images of the primary intermediate transfer bodies in a recording medium transport direction; and a charge removal unit disposed between the plural secondary transfer units, the charge removal unit being configured to remove a charge of a recording medium charged in any of the secondary transfer units.

2. The image forming apparatus according to claim 1, further comprising:

a transport belt configured to transfer the recording medium to the plural secondary transfer units, wherein the transport belt is formed in an annular shape, the transport belt transfers the recording medium while an outer peripheral surface of the transport belt comes into contact with one surface of the recording medium, the charge removal unit is disposed inside the transport belt, and the charge removal unit removes a charge of the recording medium via the transport belt.

3. The image forming apparatus according to claim 2, wherein the charge removal unit is a driven roller that is in contact with an inner peripheral surface of the transport belt and is driven and rotated by the transport belt.

4. The image forming apparatus according to claim 1, wherein a transport belt transports the recording medium from a lower side to an upper side in a gravitational direction, and a first intermediate transfer belt and a second intermediate transfer belt overlap with each other vertically in the gravitational direction.

5. The image forming apparatus according to claim 1, wherein the charge removal unit applies, to the recording medium, a charge having an opposite polarity to that of the recording medium charged at a first transfer position, by being applied a voltage.

6. The image forming apparatus according to claim 5, further comprising:

a receiving unit configured to receive information on the recording medium, wherein a voltage applied to the charge removal unit is changed based on the information received by the receiving unit.

7. The image forming apparatus according to claim 1, wherein the charge removal unit is provided on a non-image surface side that is opposite to an image surface of the recording medium, and the charge removal unit is controlled so that when the recording medium has a high resistance, the charge removal unit executes charge removal.

* * * * *